US012291388B2

(12) United States Patent
Uchida

(10) Patent No.: US 12,291,388 B2
(45) Date of Patent: May 6, 2025

(54) CONTAINER

(71) Applicant: SAKAI DISPLAY PRODUCTS CORPORATION, Sakai (JP)

(72) Inventor: Takashi Uchida, Sakai (JP)

(73) Assignee: SAKAI DISPLAY PRODUCTS CORPORATION, Sakai (JP)

( * ) Notice: Subject to any disclaimer, the term of this patent is extended or adjusted under 35 U.S.C. 154(b) by 102 days.

(21) Appl. No.: 18/134,513

(22) Filed: Apr. 13, 2023

(65) Prior Publication Data

US 2023/0348168 A1 Nov. 2, 2023

(30) Foreign Application Priority Data

Apr. 28, 2022 (JP) ..... 2022-074151

(51) Int. Cl.
*B65D 81/05* (2006.01)
*B65D 81/107* (2006.01)
*B65D 85/48* (2006.01)

(52) U.S. Cl.
CPC ..... *B65D 81/053* (2013.01); *B65D 81/107* (2013.01); *B65D 85/48* (2013.01); *B65D 2581/055* (2013.01)

(58) Field of Classification Search
CPC ..... B65D 81/053; B65D 81/107; B65D 85/48
USPC ..... 206/449, 453, 454
See application file for complete search history.

(56) References Cited

U.S. PATENT DOCUMENTS 9,038,824 B2 * 5/2015 Zhao ..... B65D 81/02 206/453
9,643,772 B2 * 5/2017 Yue ..... B65D 85/48
2013/0306514 A1 * 11/2013 Hu ..... B65D 81/053 206/586
2014/0202909 A1 * 7/2014 Kuo ..... B65D 85/48 206/453
2014/0311935 A1 * 10/2014 Yue ..... B65D 85/48 206/454
2015/0041361 A1 * 2/2015 Hong ..... B65D 81/107 206/723
2016/0114955 A1 * 4/2016 Zhao ..... H01L 21/67369 206/722
2017/0291736 A1 * 10/2017 Hao ..... B65B 5/04

FOREIGN PATENT DOCUMENTS

JP 2014-009019 A 1/2014

* cited by examiner

*Primary Examiner* — Rafael A Ortiz
(74) *Attorney, Agent, or Firm* — ScienBiziP, P.C.

(57) ABSTRACT

A container includes a container main body and a cushioning. The container main body is configured with an accommodation space that is to accommodate a to-be-accommodated object with a flat plate shape. The container main body includes a base, a side wall, and a recess. The recess is formed in a peripheral part of the base and recessed from a surface of the base. The cushioning is to be set in the recess in multiple different postures. The cushioning has a first surface including a first receiving surface and a second receiving surface. In a state in which the cushioning in a first posture or a second posture is set in the recess, the first receiving surface or the second receiving surface faces the accommodation space and the second receiving surface or the first receiving surface is buried in the recess.

13 Claims, 28 Drawing Sheets

CONTAINER

INCORPORATION BY REFERENCE

The present application claims priority under 35 U.S.C. § 119 to Japanese Patent Application No. 2022-074151, filed on Apr. 28, 2022. The contents of this application are incorporated herein by reference in their entirety.

BACKGROUND

The present disclosure relates to a container.

A prior art package can achieve packing without need to increase the number of components thereof even in a situation in which one type of panel-shaped to-be-packed articles among types different in at least width is selected and the to-be-packed articles of the selected types are packed.

Specifically, the package includes a container main body, a lid, and a side protection member that protects side parts of the opposite sides of the selected to-be-packed articles. A plurality of side protection arms with lengths according to the different types of to-be-packed articles are formed on the side protection member, and a fitting recess to which the side protection members are to be fitted are formed in the container main body.

SUMMARY

According to an aspect of the present disclosure, a container includes a container main body and a cushioning. The container main body is configured with an accommodation space that is to accommodate a to-be-accommodated object with a flat plate shape. The cushioning is to be set in the container main body. The container main body includes a base, a side wall, and a recess. The side wall stands from the base. The recess is formed in a peripheral part of the base and recessed from a surface of the base. The cushioning is to be set in the recess in multiple different postures. The cushioning has a first surface including a first receiving surface and a second receiving surface. In a state in which the cushioning in a first posture is set in the recess, the first receiving surface faces the accommodation space and the second receiving surface is buried in the recess. In a state in which the cushioning in a second posture is set in the recess, the second receiving surface faces the accommodation space and the first receiving surface is buried in the recess.

DETAILED DESCRIPTION

Figure 1:
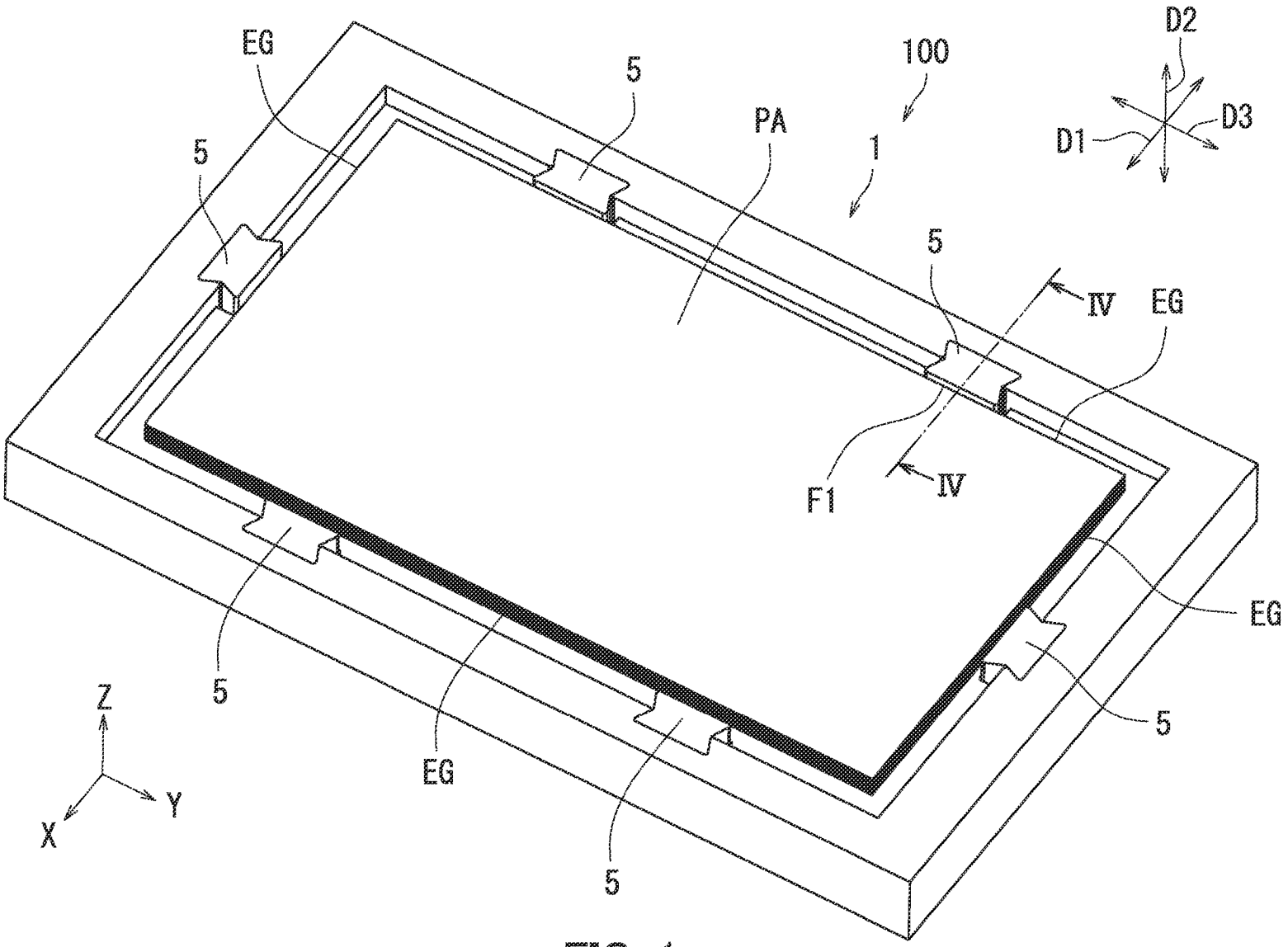
FIG. 1 is a perspective view of a state in which a container according to a first embodiment of the present disclosure accommodates a plurality of to-be-accommodated objects.

The following described embodiments of the present disclosure with reference to the accompanying drawings. Note that elements that are the same or equivalent are indicated by the same reference signs in the drawings and description thereof is not repeated. Furthermore, a three-dimensional Cartesian coordinate system (X, Y, Z) is indicated in drawings as appropriate for the sake of explanation. In the drawings, an X axis and a Y axis are parallel to the horizontal direction and a Z axis is parallel to the vertical direction.

First Embodiment

Figure 2:
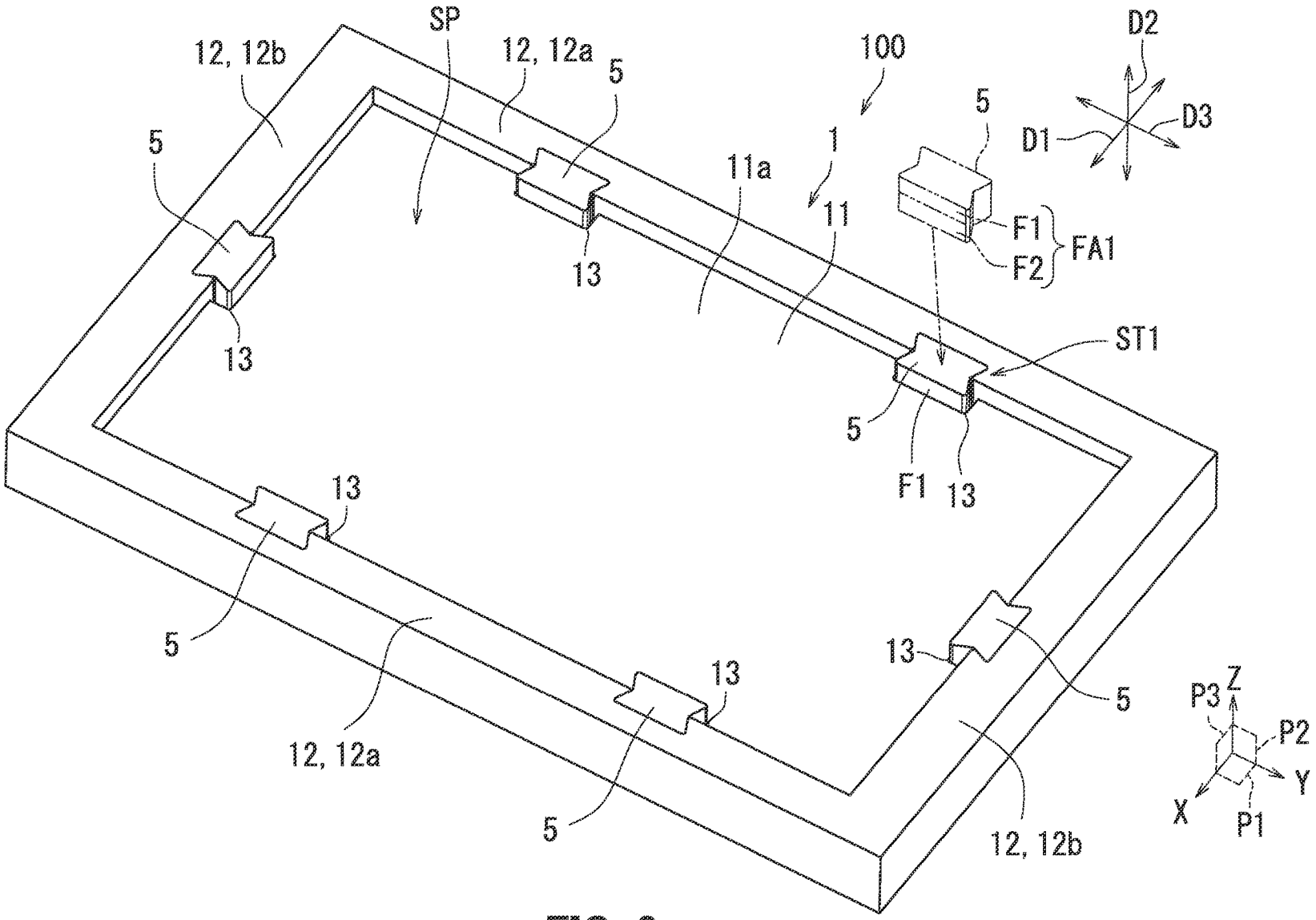
FIG. 2 is a perspective view of a state in which the container according to the first embodiment does not accommodate the to-be-accommodated objects.

Description will be made of a container 100 according to a first embodiment of the present disclosure with reference to FIGS. 1 to 9. First, the container 100 will be described with reference to FIGS. 1, 2, 3A, and 3B. FIG. 1 is a perspective view of the container 100 in a state of accommodating a plurality of to-be-accommodated objects PA. FIG. 2 is a perspective view of the container 100 in an empty state of not accommodating the to-be-accommodated objects PA.

As illustrated in FIG. 1, the container 100 is a packaging container that is to accommodate the to-be-accommodated objects PA. The to-be-accommodated objects PA have a flat plate shape. In the example illustrated in FIG. 1, the to-be-accommodated objects PA are substantially rectangular in shape. For example, the to-be-accommodated objects PA each are a glass sheet or a panel (e.g., liquid-crystal panel) for display. Note that the container 100 may accommodate one to-be-accommodated object PA.

The container 100 includes a container main body 1 and one or more (6 in the present embodiment) cushionings 5. The cushionings 5 are elastic and protect the to-be-accommodated object PA (specifically, edges EG of the to-be-accommodated object PA). The cushionings 5 absorb impact and vibration, which the to-be-accommodated objects PA receives, through its own deformation. In the first embodiment, the container main body 1 is a solid member (integrally molded product). The to-be-accommodated objects PA are accommodated in a manner to be stacked in a second direction D2.

The container main body 1 and the cushionings 5 are formed of a foaming material, for example. Examples of the foaming material includes foamed polystyrene, foamed polyethylene, foamed polypropylene, and foamed polyurethane. The container main body 1 and the cushionings 5 may be made of the same material or different materials.

As illustrated in FIG. 2, the container main body 1 includes a base 11, a plurality of (4 in the present embodiment) side walls 12, and one or more (6 in the present embodiment) recesses 13. The four side walls 12 include paired side walls 12*a* and paired side walls 12*b*.

The base 11 has a rectangular flat plate shape. The paired side walls 12*a* are opposite to each other with a space therebetween. The paired side walls 12*b* are opposite to each other with a space therebetween. One of the paired side walls 12*a* has opposite ends that are connected to corresponding one ends of the paired side walls 12*b*. The other of the paired side walls 12*a* has opposite ends that are connected to the other ends of the paired side walls 12*b*. The paired side walls 12*a* and the paired side walls 12*b* form a substantially rectangular flame.

The paired side walls 12*a* and the paired side walls 12*b* stand from the base 11. Specifically, the base 11 expands to the lower ends of the side walls 12*a* and the lower ends of the side walls 12*b*. The side walls 12*a* and the side walls 12*b* stand from a surface 11*a* of the base 11. The paired side walls 12*a* extend along two of the four sides of the base 11 in a certain direction. The paired side walls 12*b* extend along the other two of the four sides of the base 11 in a direction substantially perpendicular to the direction in which the paired side walls 12*a* extends.

The container main body 1 is configured with an accommodation space SP that is to accommodate the to-be-accommodated objects PA (FIG. 1). The accommodation space SP is a space defined by the base 11 and the side walls 12*a* and 12*b*. The to-be-accommodated objects PA are stacked on the base 11.

The one or more cushionings 5 are set in the container main body 1 along the four sides of the container main body 1 (four sides of the base 11). Specifically, the cushionings 5 are set in the recesses 13. The cushioning 5 are capable of being set in the recesses 13 in multiple different postures. Although description will be made later in detailed, the cushioning 5 is capable of being set in the recess 13 in at least two mutually different postures (a first posture ST1 and a second posture ST2) in the first embodiment. In FIG. 2, a cushioning 5 is set in a recess 13 in the first posture ST1. The one or more recesses 13 are formed in the container main body 1 along the four sides of the container main body 1. The recesses 13 are recessed from the surface 11*a* of the base 11. Parts of the cushionings 5 protrude from the side walls 12 toward the accommodation space SP while the cushionings 5 are set in the recesses 13.

Each of the cushionings 5 has a first surface FA1. The first surface FA1 includes a first receiving surface F1 and a second receiving surface F2. The first receiving surface F1 is located inward of the side walls 12 and faces the accommodation space SP with the cushioning in the first posture ST1 set in the recess 13 (in the first posture state). The second receiving surface F2 is buried in the recess 13 in the first posture state so as not to face the accommodation space SP. Note that the boundary between the first receiving surface F1 and the second receiving surface F2 is indicated by a two-dot chain line in FIG. 2 for the sake of easy understanding.

Figure 3A:
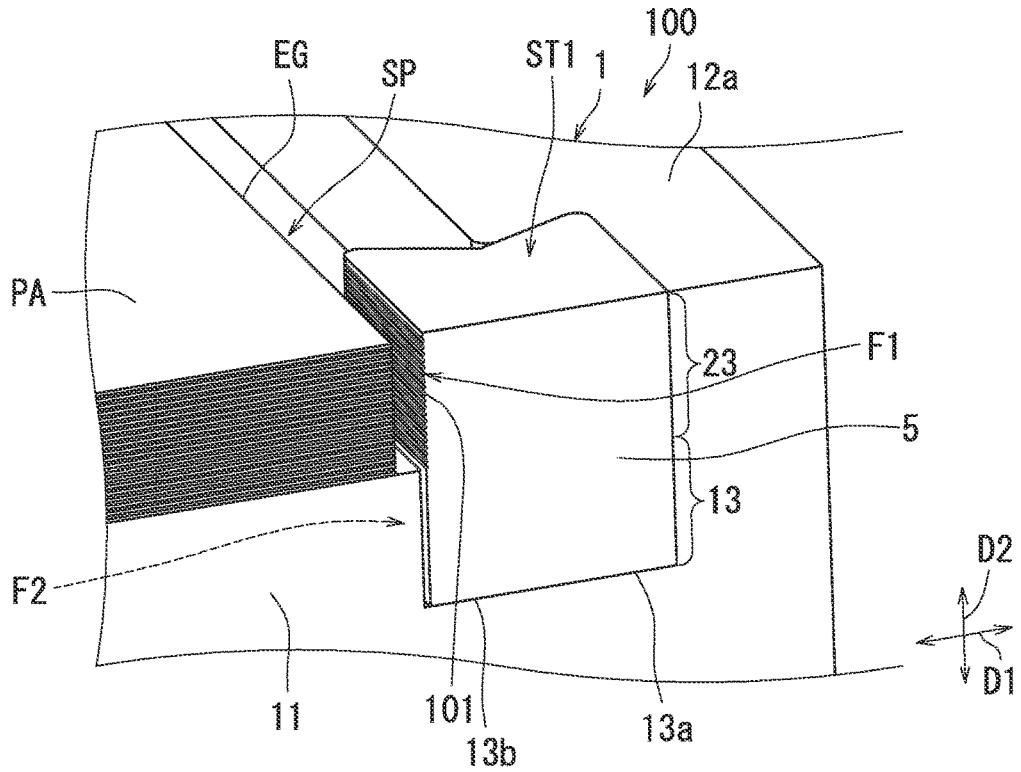
FIG. 3A is a cross-sectional perspective view of a first posture of a cushioning according to the first embodiment.
Figure 3B:
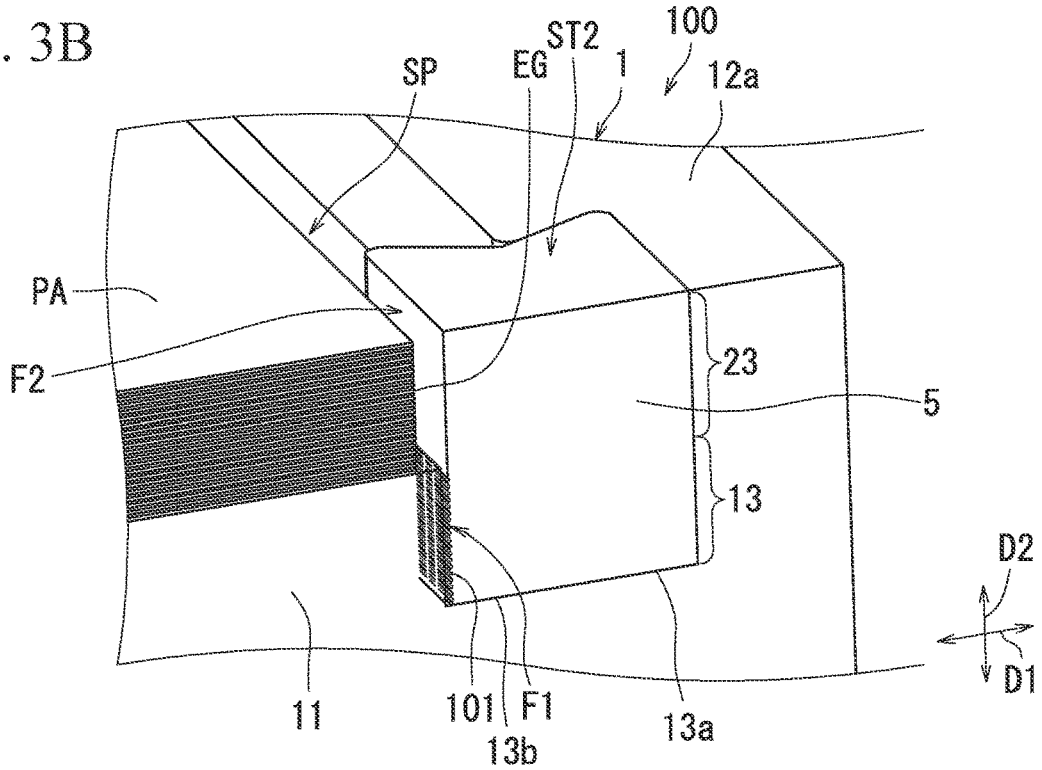
FIG. 3B is a cross-sectional perspective view of a second posture of the cushioning according to the first embodiment.

The first posture ST1 and the second posture ST2 of the cushioning 5 will be described next with reference to FIGS. 3A and 3B. FIG. 3A is a cross-sectional perspective view of a state in which a cushioning 5 in the first posture ST1 is set in a recess 13. In FIG. 3A, the first receiving surface F1 of the cushioning 5 faces the to-be-accommodated objects PA. Specifically, FIG. 3A is a cross-sectional perspective view taken along a line IV-IV in FIG. 1. FIG. 3B is a cross-sectional perspective view of a state in which the cushioning 5 in the second posture ST2 is set in the recess 13. In FIG. 3B, the second receiving surface F2 of the cushioning 5 faces the to-be-accommodated objects PA. Note that hatching indicating a section is omitted in FIGS. 3A and 3B to make the drawings easier to read.

As illustrated in FIG. 3A, the first receiving surface F1 faces the accommodation space SP while the second receiving surface F2 is buried in the recess 13 in the first posture state. By contrast, as illustrated in FIG. 3B, the second receiving surface F2 faces the accommodation space SP while the first receiving surface F1 is burred in the recess in a state in which the cushioning 5 in the second posture ST2 is set in the recess 13 (in the second posture state). As such, according to the first embodiment, performance of the cushioning 5 can be maintained by changing the posture of the cushioning 5 between the first posture ST1 and the second posture ST2 even in a case in which the container 100 repeatedly accommodates to-be-accommodated objects PA of the same size.

In detail, as illustrated in FIG. 3A, the first receiving surface F1 of the cushioning 5 in the first posture ST1 faces the to-be-accommodated object PA to serve as a receiving surface for the to-be-accommodated objects PA (a surface for receiving the to-be-accommodated objects PA that move in the accommodation space SP and mitigating impact). For example, in transportation, the edges EG of the to-be-accommodated objects PA hit on or strike in the first receiving surface F1 to form dents 101 in the first receiving surface F1. As a result, when completion of transportation or the like is followed by another accommodation of new to-be-accommodated objects PA of the same size in a state in which the first receiving surface F1 serves again as a receiving surface, protection performance of the first receiving surface F1 for the new to-be-accommodated objects PA may be impaired.

In view of the foregoing, in another accommodation of the to-be-accommodated objects PA of the same size, the posture of the cushioning 5 is changed from the first posture ST1 to the second posture ST2 so that the second receiving surface F2, which has not been used, faces the to-be-accommodated objects PA as illustrated in FIG. 3B. That is, the posture of the cushioning 5 is changed so that the unused second receiving surface F2 serves as a receiving surface for the to-be-accommodated objects PA. As a result, the second receiving surface F2 can effectively protect the to-be-accommodated objects PA.

In other words, posture change of the cushioning 5 can maintain performance of the cushioning 5 even in a case in which accommodation of the to-be-accommodated objects PA of the same size is repeated. In the example illustrated in FIGS. 3A and 3B, performance of the cushioning 5 is maintained by flipping the cushioning 5 upside down. That is, flipping the cushioning 5 upside down changes the posture of the cushioning 5 between the first posture ST1 and the second posture ST2 to change the to-be-used receiving surface.

Figure 4:
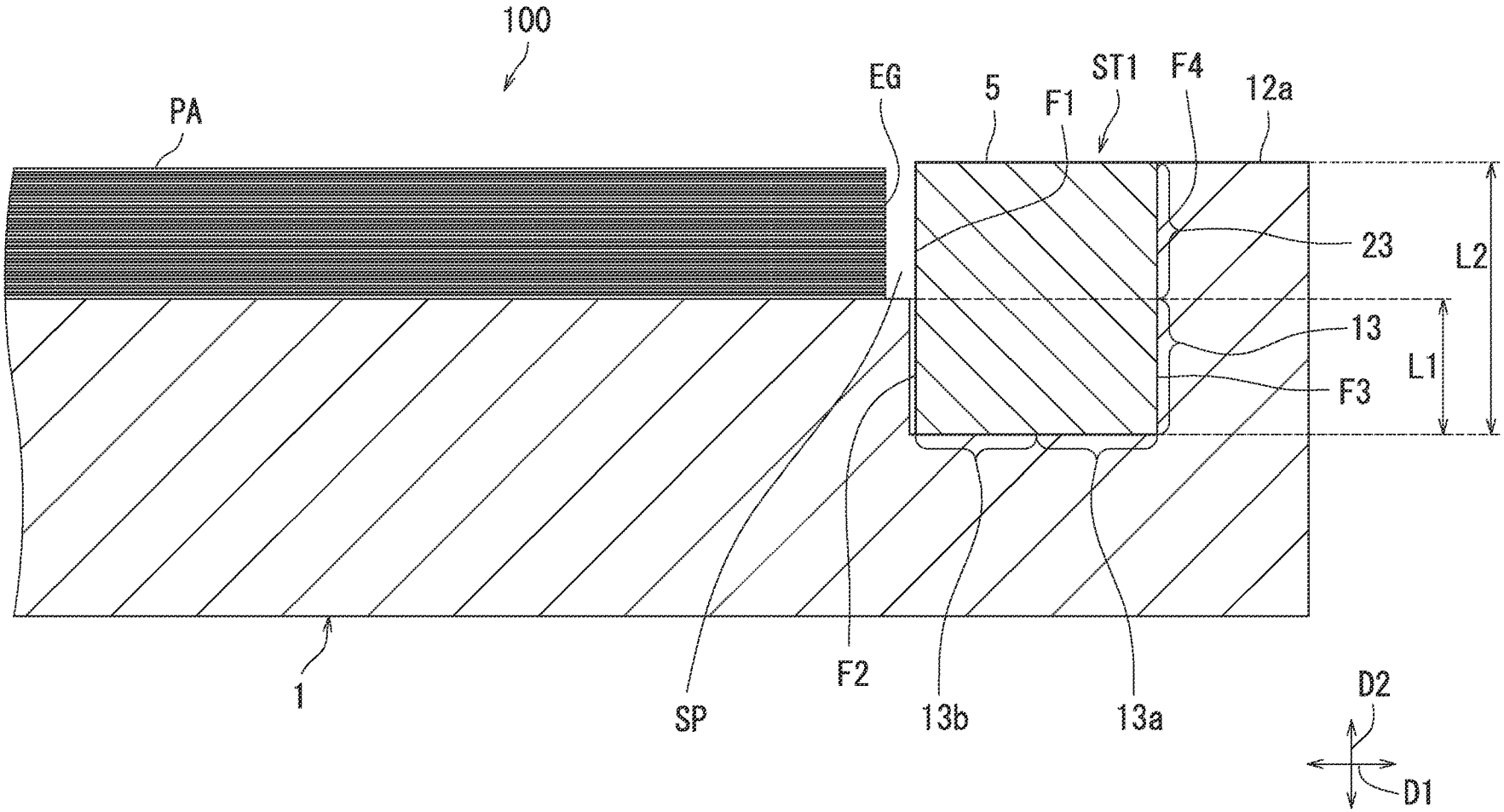
FIG. 4 is a cross-sectional view taken along a line IV-IV in FIG. 1.

The relationship between the size of the cushioning 5 and the size of the recess 13 will be described next with reference to FIG. 4. FIG. 4 is a cross-sectional view taken along a line IV-IV in FIG. 1. As illustrated in FIG. 4, the recess 13 has a depth L1 substantially equal to half a length L2 of the cushioning 5 in the second direction D2. In the above configuration, the first receiving surface F1 that has been used as a receiving surface can be avoided from facing the to-be-accommodated objects PA by changing the receiving surface for the to-be-accommodated objects PA from the first receiving surface F1 to the second receiving surface F2 in posture change of the cushioning 5. In other words, when the receiving surface for to-be-accommodated objects PA is changed from the first receiving surface F1 to the second receiving surface F2, the first receiving surface F1 that has been used as a receiving surface can be avoided from being exposed to the accommodation space SP. Therefore, performance of the cushioning 5 can be reliably maintained by posture change of the cushioning 5.

Next, a first direction D1, the second direction D2, and a third direction D3 in a state in which the cushioning 5 is set in the recess 13 are defined with reference to FIG. 2. In this case, attention is focused on a side wall 12*a* of the side walls 12*a* and 12*b* for the sake of explanation.

As illustrated in FIG. 2, the first direction D1 is a direction substantially perpendicular to the first surface FA1. In the present embodiment, the first direction D1 is a direction substantially perpendicular to an inner surface 121 of the side wall 12*a*, in other words, substantially perpendicular to a direction in which the side wall 12*a* extends and substantially parallel to the surface 11*a* of the base 11 in a state in which the cushioning 5 is set in the recess 13. The second direction D2 is a direction substantially perpendicular to the first direction D1. The second direction D2 is a direction substantially perpendicular to the surface 11*a* of the base 11 in a state in which the cushioning 5 is set in the recess 13. The third direction D3 is a direction substantially perpendicular to the first direction D1 and the second direction D2. In the present embodiment, the third direction D3 is a direction substantially parallel to the first surface FA1 and the surface 11*a* of the base 11, in other words, a direction substantially parallel to the surface 11*a* of the base 11 and the direction in which the side wall 12*a* extends in a state in which the cushioning 5 is set in the recess 13.

Figure 5:
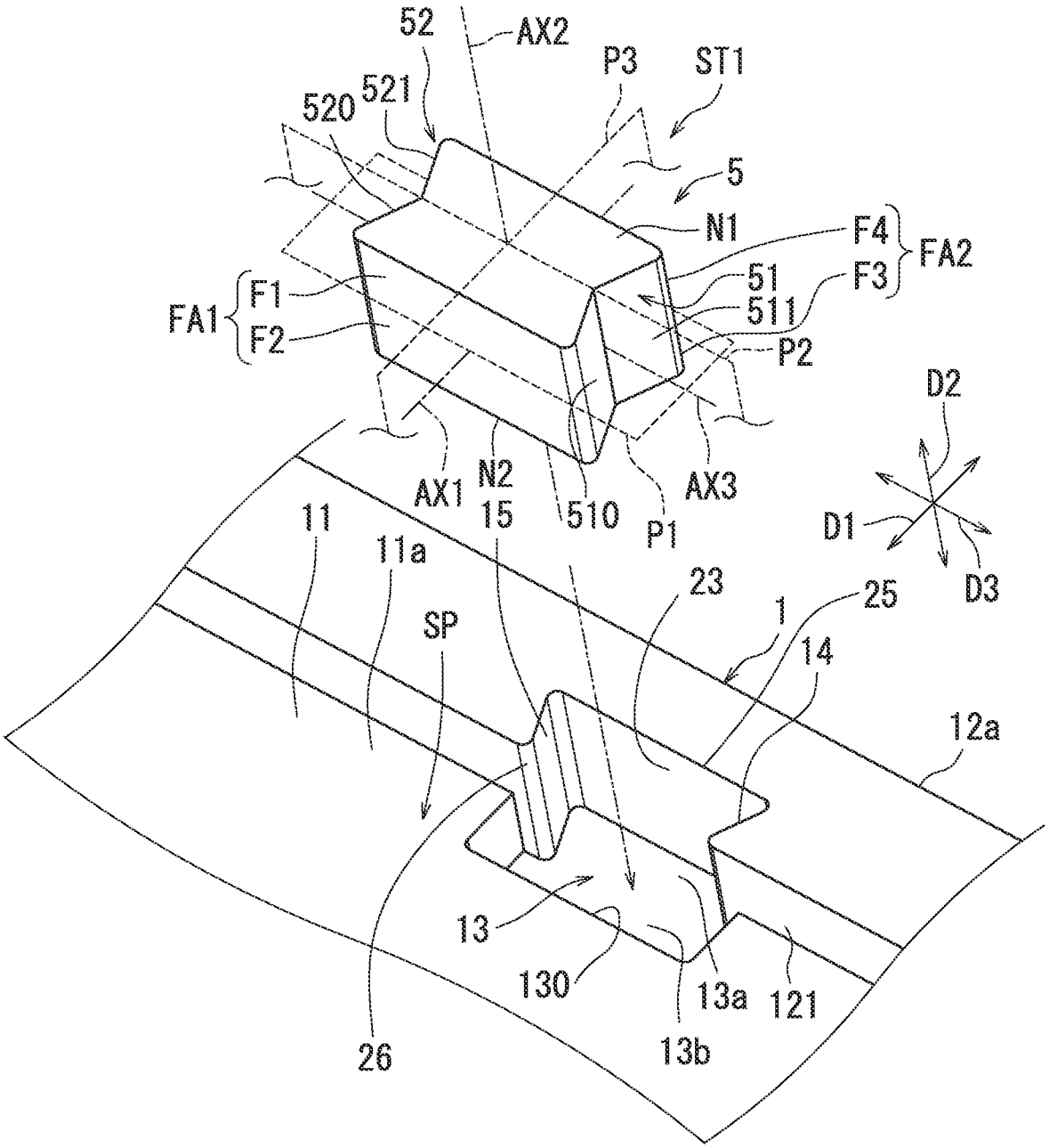
FIG. 5 is a perspective view of a recess in a container main body and the cushioning before being set in the recess according to the first embodiment.
Figure 6:
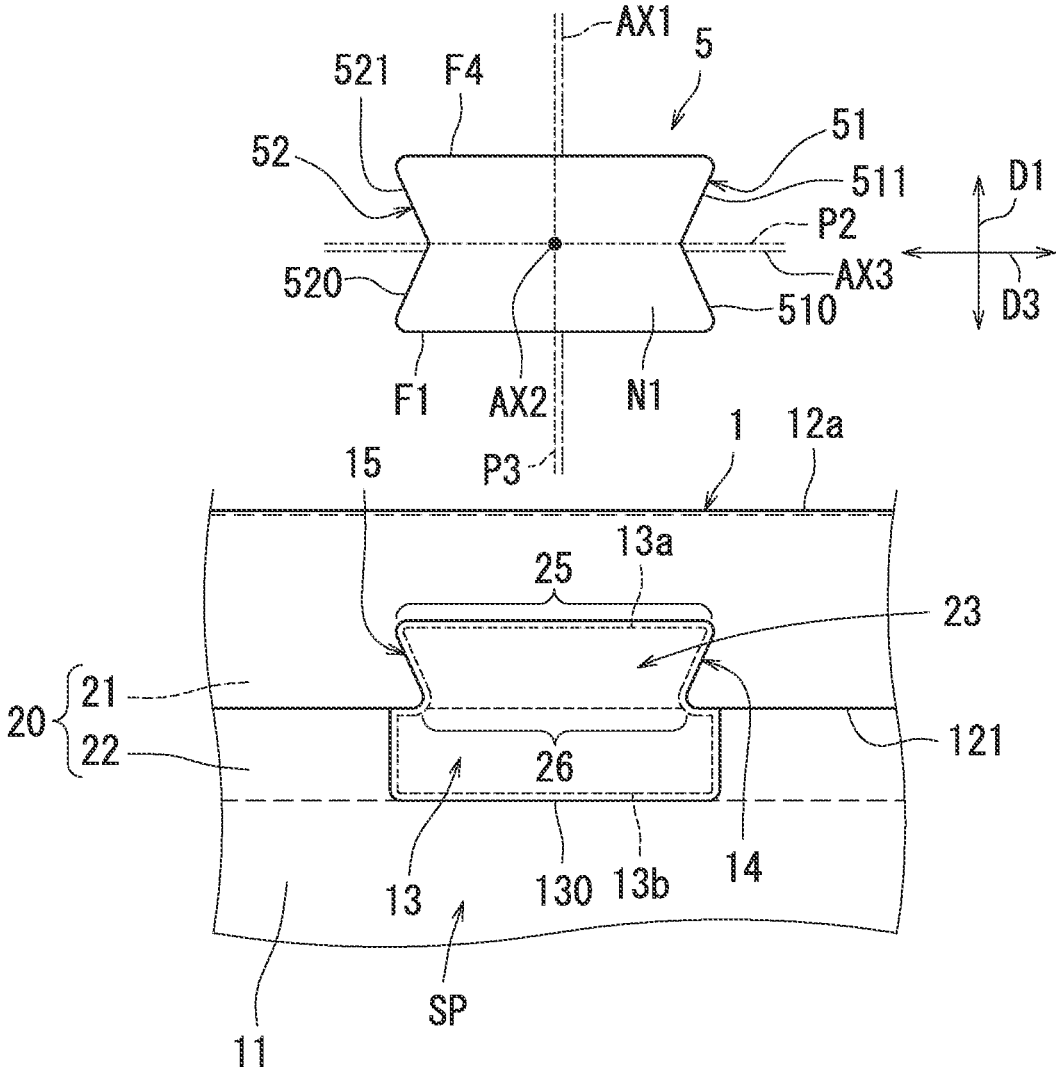
FIG. 6 is a planar view of the recess in the container main body and the cushioning before being set in the recess according to the first embodiment.

The cushioning 5 and the recess 13 will be described next with reference to FIGS. 5 and 6. FIG. 5 is a perspective view of the recess 13 in the container main body 1 and the cushioning 5 before being set in the recess 13. FIG. 6 is a planar view of the recess 13 in the container main body 1 and the cushioning 5 before being set in the recess 13. FIGS. 5 and 6 illustrate a case in which the cushioning 5 in the first posture ST1 is set in the recess 13.

First, a first plane P1, a second plane P2, a third plane P3, a first symmetric axis AX1, a second symmetric axis AX2, and a third symmetric axis AX3 in a state in which the cushioning 5 is set in the recess 13 are defined with reference to FIG. 5.

The first plane P1 passes through the central part of the cushioning 5 in the second direction D2 in the first posture state. The first plane P1 is substantially perpendicular to the second direction D2 and substantially parallel to the first direction D1 and the third direction D3 in the first posture state. In other words, the first plane P1 is substantially parallel to the surface 11*a* of the base 11. Furthermore, the first plane P1 is substantially perpendicular to the inner surface 121 of the side wall 12*a*. Furthermore, the first plane P1 is substantially perpendicular to the first receiving surface F1 in the first posture state. The first plane P1 corresponds to an example of a "specific plane". In the first embodiment, the first plane P1 includes the surface 11*a* of the base 11 in the first posture state.

The second plane P2 is substantially perpendicular to the surface 11*a* of the base 11 and passes through the central part of the cushioning 5 in the first direction D1 in the first posture state. Furthermore, the second plane P2 is substantially perpendicular to the first direction D1 and substantially parallel to the second direction D2 and the third direction D3. The second plane P2 is substantially parallel to the direction in which the side wall 12*a* extends. Furthermore, the second plane P2 is substantially parallel to the first receiving surface F1 in the first posture state.

The third plane P3 is substantially perpendicular to the surface 11*a* of the base 11 and passes through the central part of the cushioning 5 in the third direction D3 in the first posture state. Furthermore, the third plane P3 is substantially perpendicular to the third direction D3 and substantially parallel to the first direction D1 and the second direction D2. The third plane P3 is substantially perpendicular to the direction in which the side wall 12*a* extends. Furthermore, the third plane P3 is substantially perpendicular to the first receiving surface F1 in the first posture state. The first plane P1, the second plane P2, and the third plane P3 are substantially perpendicular to one another.

The first symmetric axis AX1 extends along the first direction D1 and serves as an axis of rotational symmetry. The first symmetric axis AX1 is located on the first plane P1 and the third plane P3. The second symmetric axis AX2 extends along the second direction D2 and serves as an axis of rotational symmetry. The second symmetric axis AX2 is located on the second plane P2 and the third plane P3. The third symmetric axis AX3 extends along the third direction D3 and serves as an axis of rotational symmetry. The third symmetric axis AX3 is located on the first plane P1 and the second plane P2.

As illustrated in FIGS. 5 and 6, the recess 13 is recessed along the second direction D2 from the surface 11*a* of the base 11 toward the back surface of the base 11. The recess 13 is a hole. Furthermore, the recess 13 may be formed in an area overlapping the side wall 12*a* in planar view. In this case, an increase in size in the first direction D1 of the container main body 1 can be suppressed.

As illustrated in FIG. 6, the recess 13 is formed in a peripheral part 20 of the base 11. Note that the range of the peripheral part 20 is indicated by broken lines in FIG. 6 for the sake of explanation. The peripheral part 20 of the base 11 extends along the side wall 12*a* (each side wall 12 in FIG. 2). The peripheral part 20 includes a first area 21 and a second area 22. The first area 21 is an area located outside a position aligned to the inner surface 121 of the side wall 12*a* in planar view. The second area 22 is a region located inside the position aligned to the inner surface 121 of the side wall 12*a* in planar view. The recess 13 is formed so as to continuously extend from the first area 21 to the second area 22. Furthermore, the recess 13 includes a first portion 13*a* and a second portion 13*b*. The first portion 13*a* is a portion of the recess 13 that belongs to the first area 21 in planar view. The second portion 13*b* is a portion of the recess 13 that belongs to the second area 22 in planar view.

As illustrated in FIGS. 3A, 3B, 5, and 6, the side wall 12*a* is configured with a cut 23. The cut 23 matches the first portion 13*a* of the recess 13 in planar view. A part of the cushioning 5 set in the recess 13 is located in the cut 23 in the side wall 12*a*. The cushioning 5 can be reliably held in the cut 23 in addition to in the recess 13.

The cushioning 5 is fitted in the recess 13. The cushioning 5 is 180-degree rotationally symmetrical (twice symmetrical) about the first symmetric axis AX1. The cushioning 5 is also 180-degree rotationally symmetrical (twice symmetrical) about the second symmetric axis AX2. The cushioning 5 is also 180-degree rotationally symmetrical (twice symmetrical) about the third symmetric axis AX3. The shape of the cushioning 5 is symmetrical with respect to the first plane P1. The shape of the cushioning 5 is also symmetrical with respect to the second plane P2. The shape of cushioning 5 is also symmetrical with respect to the third plane P3.

The cushioning 5 includes a first fit portion 51 and a second fit portion 52. The first fit portion 51 and the second fit portion 52 have the following features for example in the first posture state. That is, the first fit portion 51 and the second fit portion 52 are symmetrical with each other with respect to the third plane P3. The first fit portion 51 and the second fit portion 52 are symmetrical with each other with respect to the first plane P1. The first fit portion 51 is located at one end of the cushioning 5 in the third direction D3. The second fit portion 52 is located at the other end of the cushioning 5 in the third direction D3. In the example illustrated in FIG. 5, the first fit portion 51 and the second fit portion 52 each have a recessed shape inwardly recessed in the central part between the opposite ends in the first direction D1, and are substantially V-shaped in planar view. The first fit portion 51 and the second fit portion 52 extend along the second direction D2.

Specifically, the first fit portion 51 has a first side surface 510 and a second side surface 511. The first side surface 510 and the second side surface 511 each have a substantially rectangular and planar shape and incline relative to the first direction D1 and the third plane P3. Also, the second fit portion 52 has a third side surface 520 and a fourth side surface 521. The third side surface 520 and the fourth side surface 521 each have a substantially rectangular and planar shape and incline relative to the first direction D1 and the third plane P3.

The container main body 1 includes a first main body fit portion 14 and a second main body fit portion 15. The first main body fit portion 14 and the second main body fit portion 15 each are provided so as to continuously extend from the side wall 12*a* to the recess 13 in the second direction D2. The first main body fit portion 14 and the second main body fit portion 15 are opposite to each other with a specific distance therebetween in the third direction D3. The first main body fit portion 14 and the second main body fit portion 15 have a shape symmetrical with each other with respect to the third plane P3.

The first main body fit portion 14 engages with one of the first fit portion 51 and the second fit portion 52 according to the posture of the cushioning 5 set in the recess 13. The second main body fit portion 15 engages with the other of the first fit portion 51 and the second fit portion 52 according to the posture of the cushioning 5 set in the recess 13. In the above configuration, the cushioning 5 can be inhibited from inclining, displacing, and falling toward the accommodation space SP (inward in the first direction 1D) in the first embodiment. Furthermore, an inner wall surface 130 of the recess 13 located innermost of the recess 13 also inhibits the cushioning 5 from inclining, displacing, and falling toward the accommodation space SP. As such, damage such as cracking in the to-be-accommodated objects PA due to the to-be-accommodated objects PA coming into contact with the cushioning 5 can be inhibited from occurring for example upon an automatic machine accommodating the to-be-accommodated objects PA into the container 100 in an empty state.

The distance between the first main body fit portion 14 and the second main body fit portion 15 becomes smaller the closer they are to the accommodation space SP. That is, the distance between the first main body fit portion 14 and the second main body fit portion 15 becomes smaller toward the inside in the first direction D1.

In the example illustrated in FIG. 5, the first main body fit portion 14 has a shape along the second side surface 511 of the first fit portion 51. In the above configuration, a part of the first fit portion 51 that has the second side surface 511 engages with the first main body fit portion 14. The second main body fit portion 15 has a shape along the fourth side surface 521 of the second fit portion 52. In the above configuration, a part of the second fit portion 52 that has the fourth side surface 521 engages with the second main body fit portion 15.

Each surface of the cushioning 5 will be described next with reference to FIGS. 5 and 7. As illustrated in FIG. 5, the cushioning 5 further has a second surface FA2 that is located on the opposite side to the first surface FA1, a first non-receiving surface N1, and a second non-receiving surface N2 that is located on the opposite side to the first non-receiving surface N1. The second surface FA2 includes a third receiving surface F3 and a fourth receiving surface F4. The first surface FA1 and the second surface FA2 are located on the opposite sides to each other with the second symmetric axis AX2 therebetween. The first surface FA1 and the second surface FA2 are located on the opposite sides to each other with the third symmetric axis AX3 therebetween.

Figure 7:
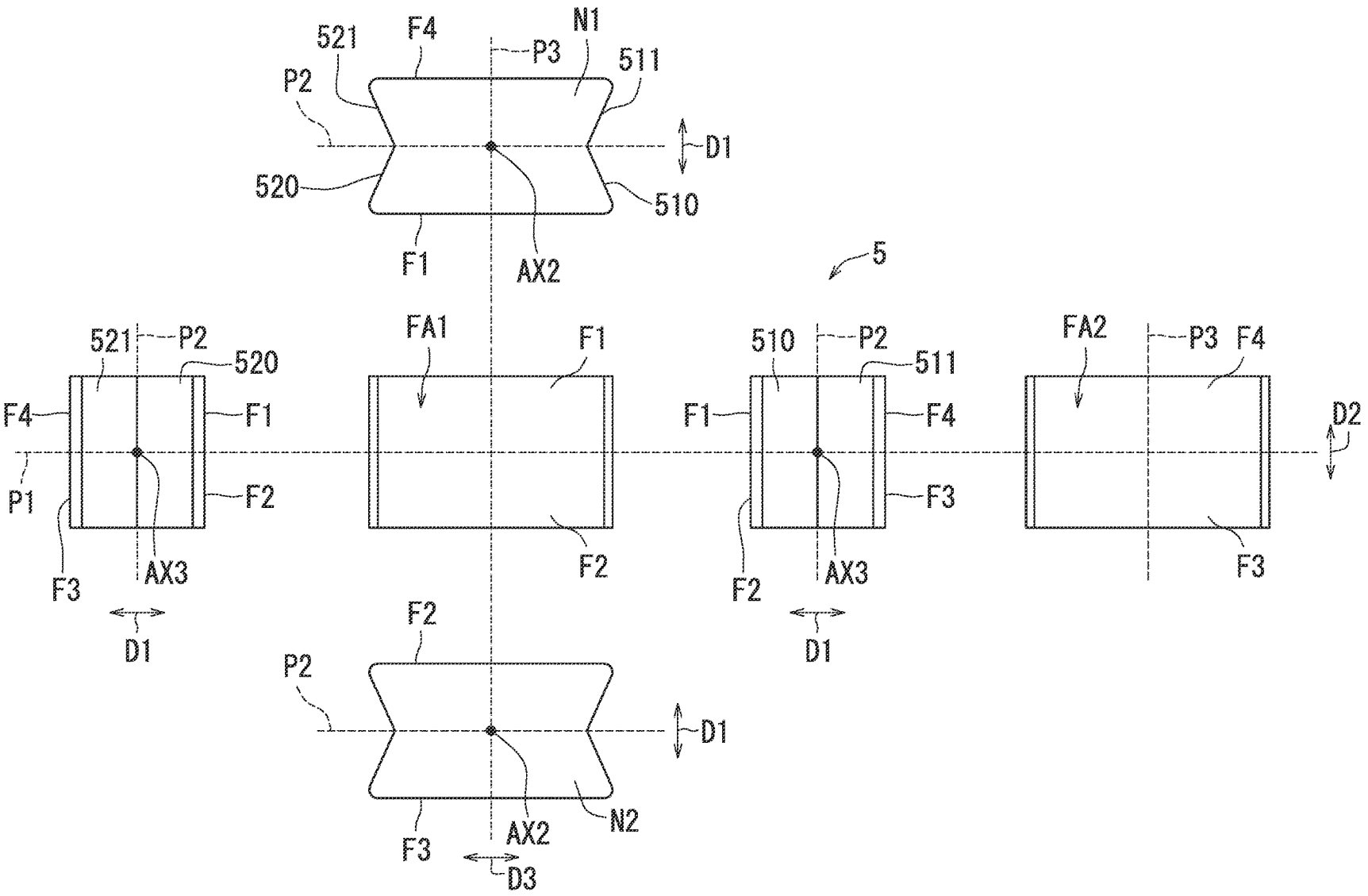
FIG. 7 is a 6-view diagram of the cushioning according to the first embodiment.

FIG. 7 is an orthographic projection (6-view diagram) of the cushioning 5 as viewed in six directions. FIG. 7 illustrates the first to third directions D1 to D3 and the first to third planes P1 to P3 in the first posture state.

As illustrated in FIG. 7, the first receiving surface F1 and the second receiving surface F2 are located side by side in the second direction D2 on the same plane. The first receiving surface F1 and the second receiving surface F2 are symmetrical with each other with respect to the first plane P1 along the base 11. The third receiving surface F3 and the fourth receiving surface F4 are located side by side in the second direction D2 on the same plane. The third receiving surface F3 and the fourth receiving surface F4 are symmetrical with each other with respect to the first plane P1.

The first receiving surface F1 and the fourth receiving surface F4 are located on the opposite sides to each other in the first direction D1 with the second symmetric axis AX2 therebetween. The first receiving surface F1 and the fourth receiving surface F4 have a shape symmetrical with respect to the second plane P2. The second receiving surface F2 and the third receiving surface F3 are located on the opposite sides to each other in the first direction D1 with the second symmetric axis AX2 therebetween. The second receiving surface F2 and the third receiving surface F3 have a shape symmetrical with respect to the second plane P2.

The first receiving surface F1 and the third receiving surface F3 are point symmetrical with each other with respect to the third symmetric axis AX3. The second receiving surface F2 and the fourth receiving surface F4 are point symmetrical with each other with respect to the third symmetric axis AX3. Note that the first surface FA1, the second surface FA2, and the first to fourth receiving surfaces F1 to F4 are planar in the example illustrated in FIG. 7.

The first side surface 510 and the second side surface 511 have a shape symmetrical with respect to the second plane P2. The third side surface 520 and the fourth side surface 521 have a shape symmetrical with respect to the second plane P2. The first side surface 510 and the third side surface 520 have a shape symmetrical with respect to the third plane P3. The second side surface 511 and the fourth side surface 521 have a shape symmetrical with respect to the third plane P3.

The first non-receiving surface N1 and the second non-receiving surface N2 are planar and substantially in parallel to the first plane P1 and the surface 11*a* of the base 11. The first non-receiving surface N1 and the second non-receiving surface N2 are located on the opposite sides to each other in the second direction D2. The first non-receiving surface N1 and the second non-receiving surface N2 each are not a receiving surface for the to-be-accommodated objects PA.

Figure 8:
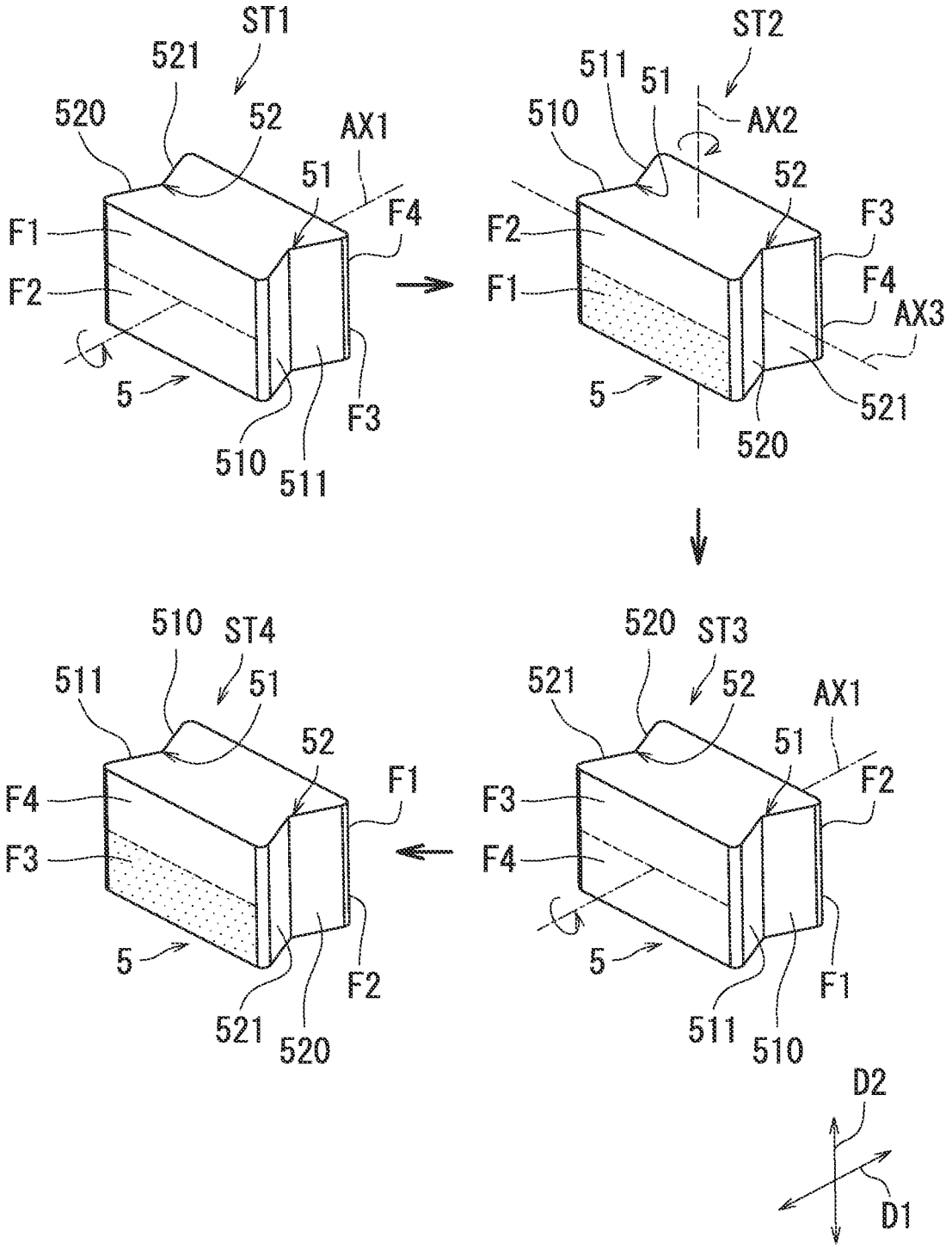
FIG. 8 is a perspective view of first to fourth postures of the cushioning according to the first embodiment alone in a case in which the cushioning is reused.
Figure 9:
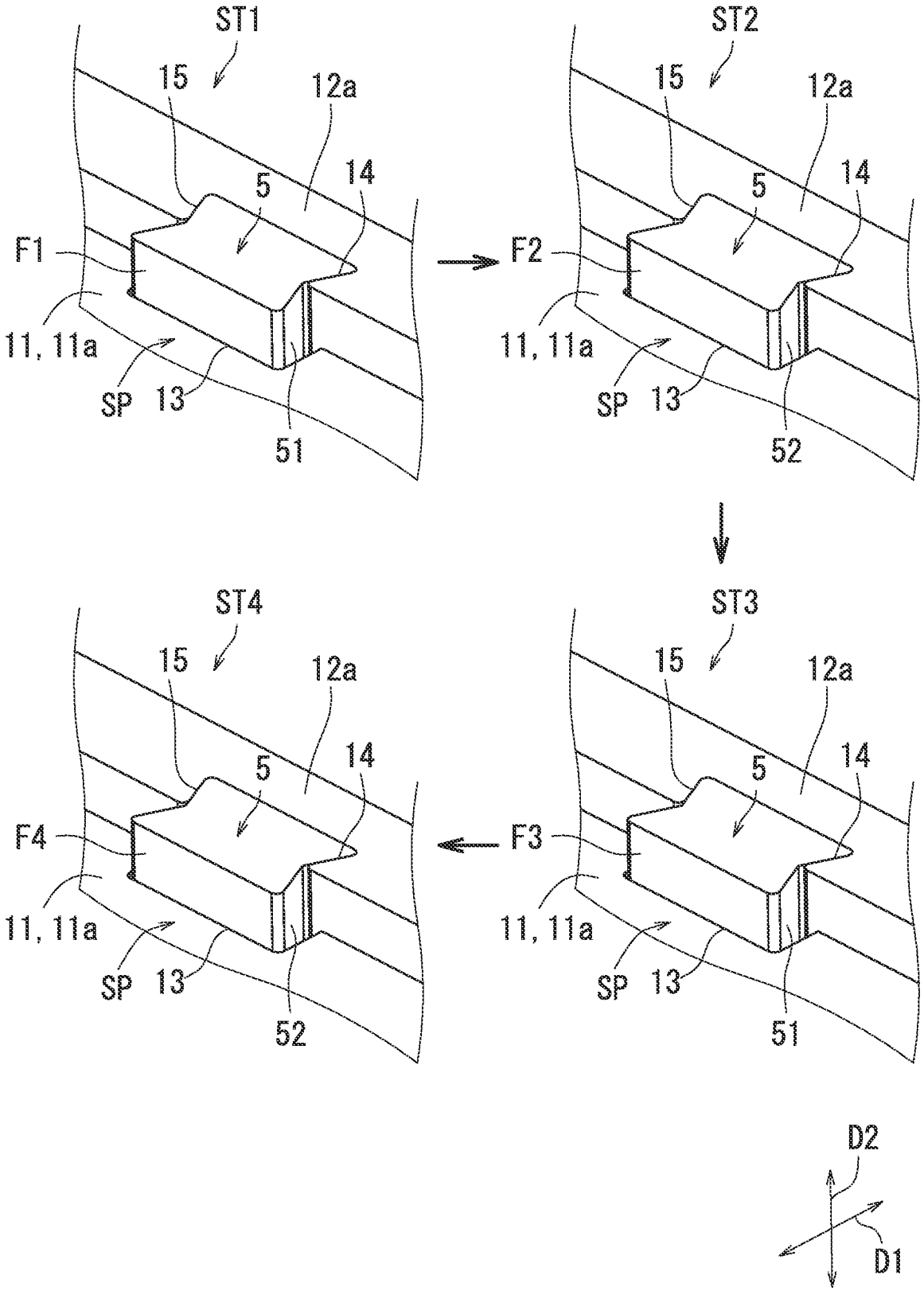
FIG. 9 is a perspective view of the first to fourth postures of the cushioning according to the first embodiment in a case in which the cushioning is reused.
Figure 10:
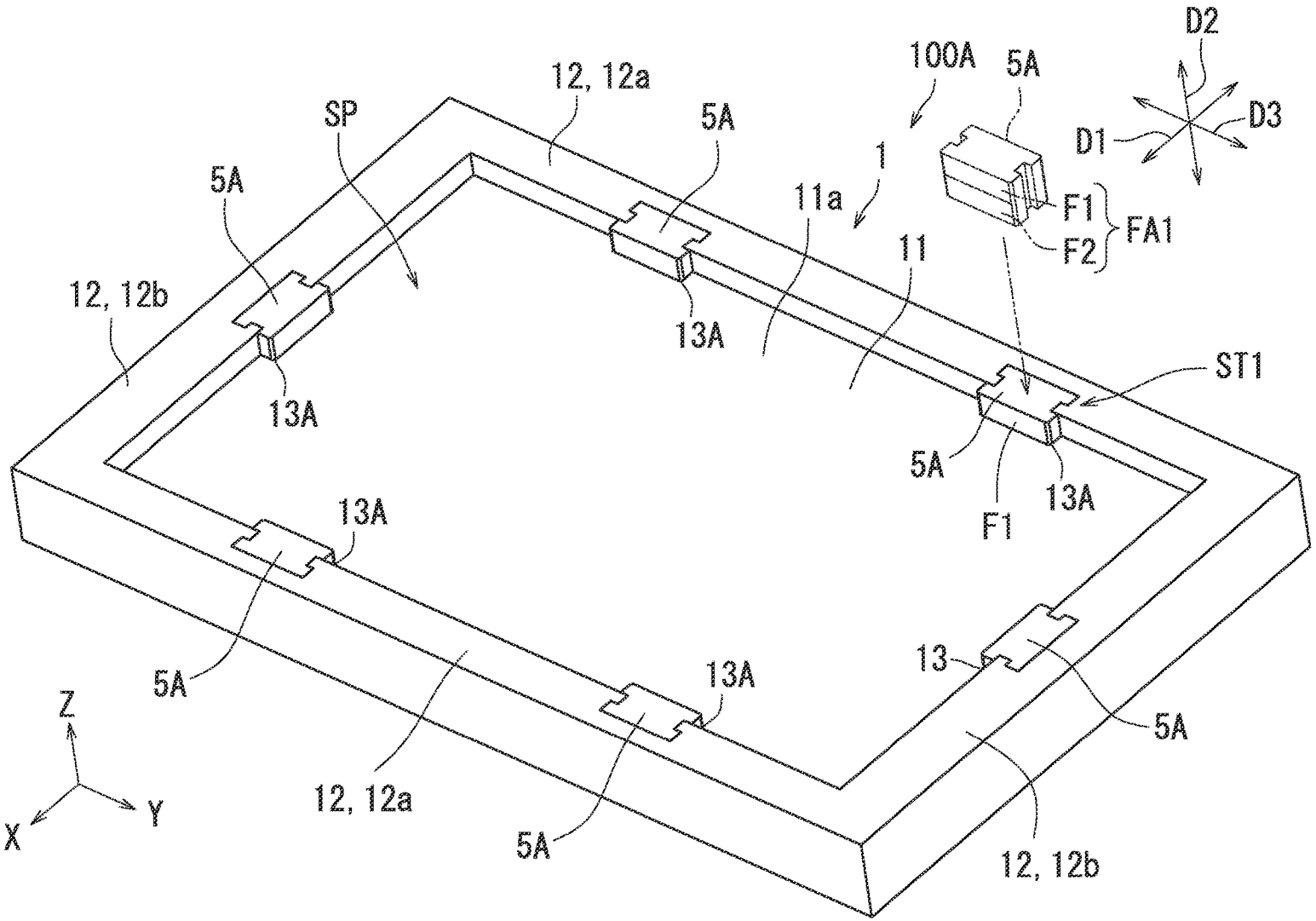
FIG. 10 is a perspective view of a state in which a container according to a first variation of the first embodiment does not accommodate the to-be-accommodated objects.
Figure 11:
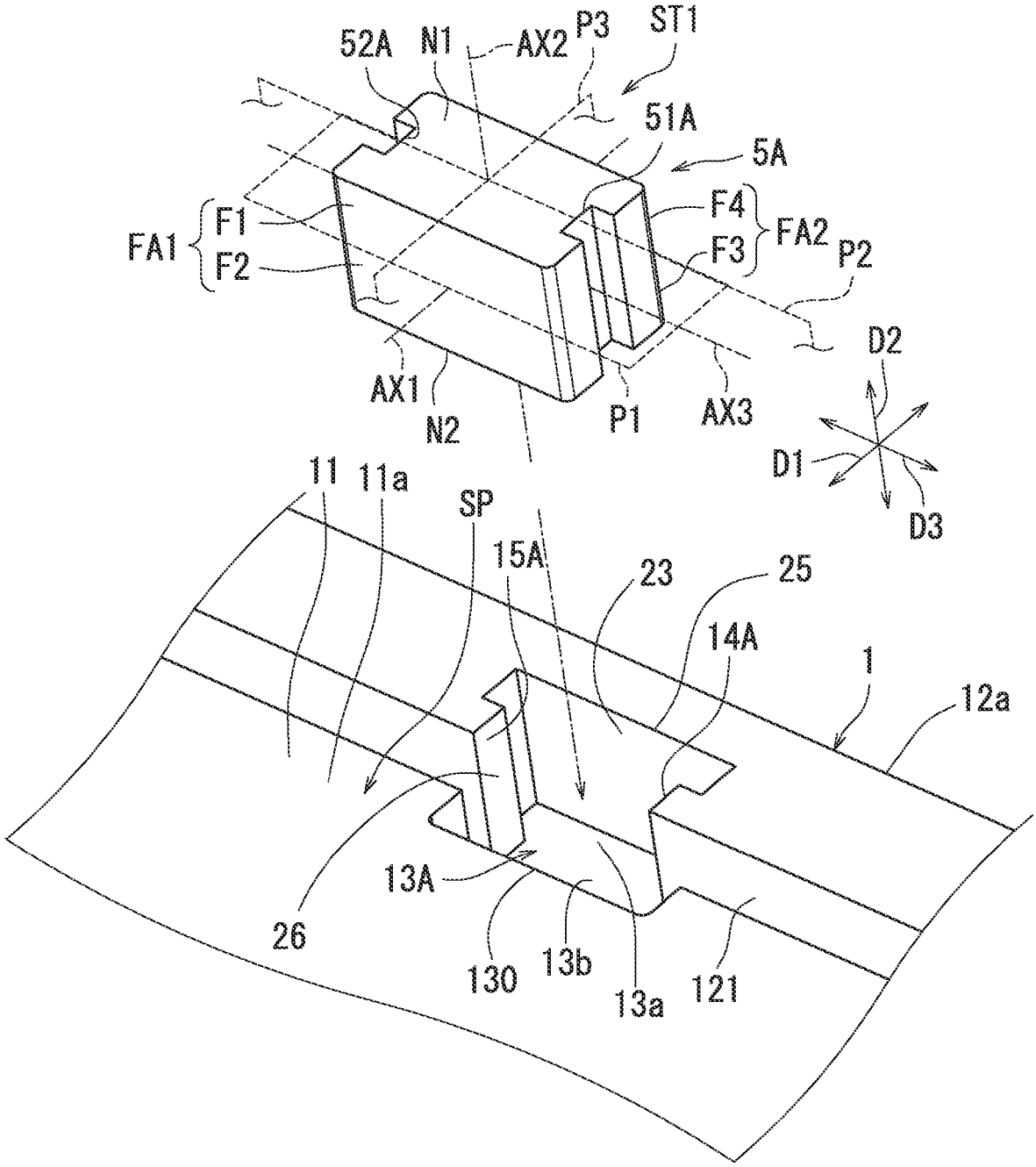
FIG. 11 is a perspective view of a recess in a container main body and a cushioning before being set in a recess according to the first variation.
Figure 12:
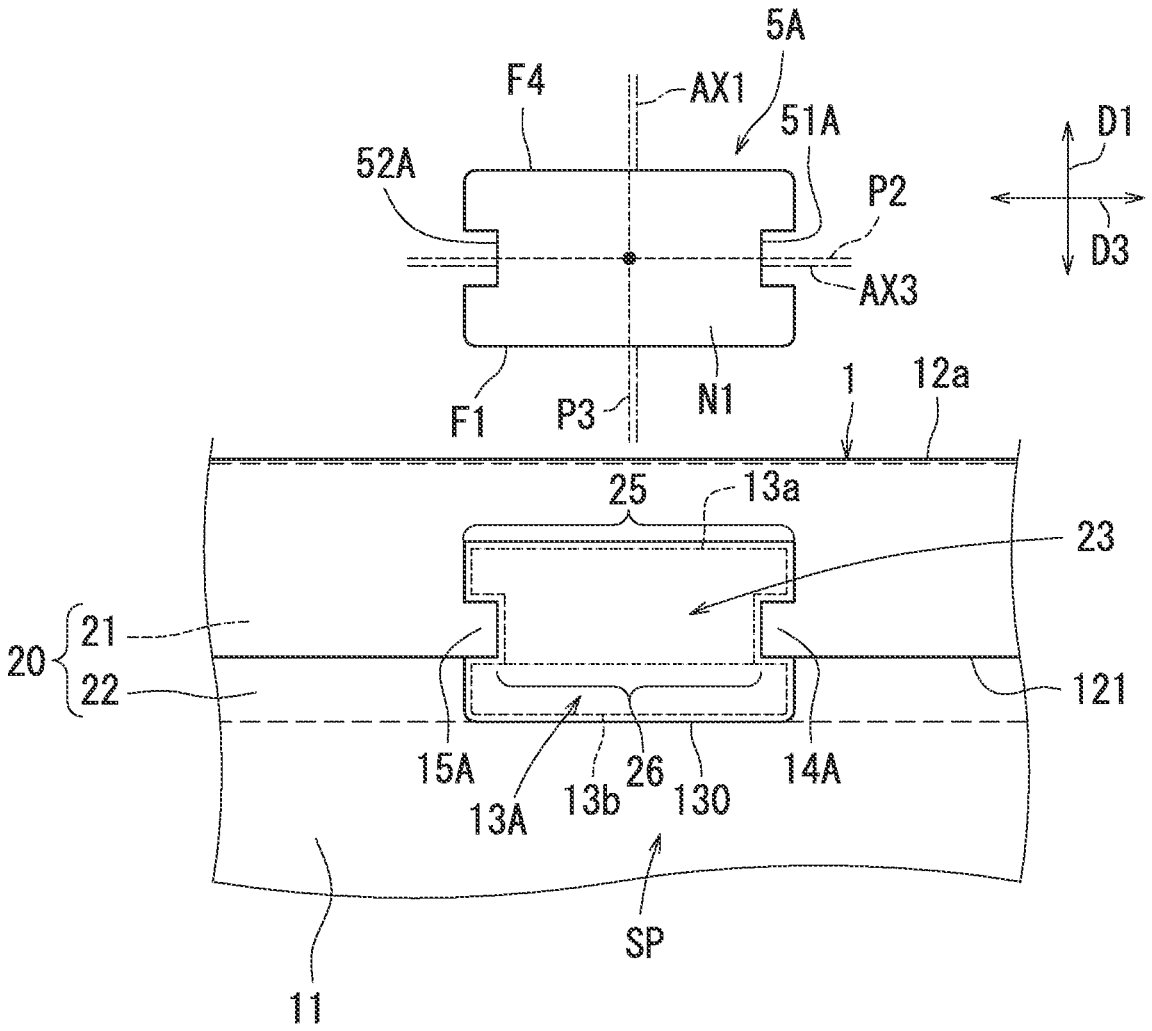
FIG. 12 is a planar view of the recess in the container main body and the cushioning before being set in the recess according to the first variation.
Figure 13:
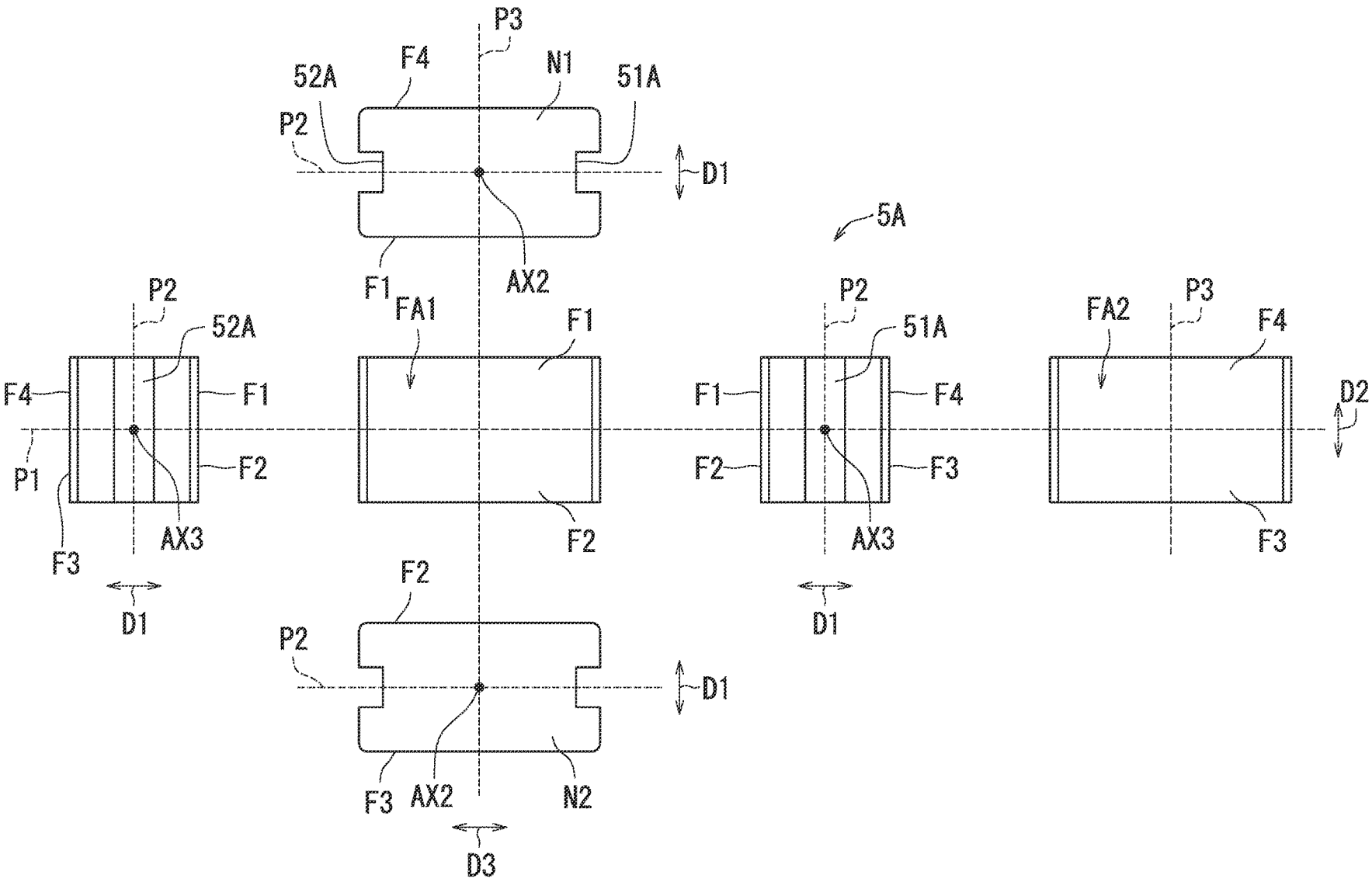
FIG. 13 is a 6-view diagram of the cushioning according to the first variation.
Figure 14:
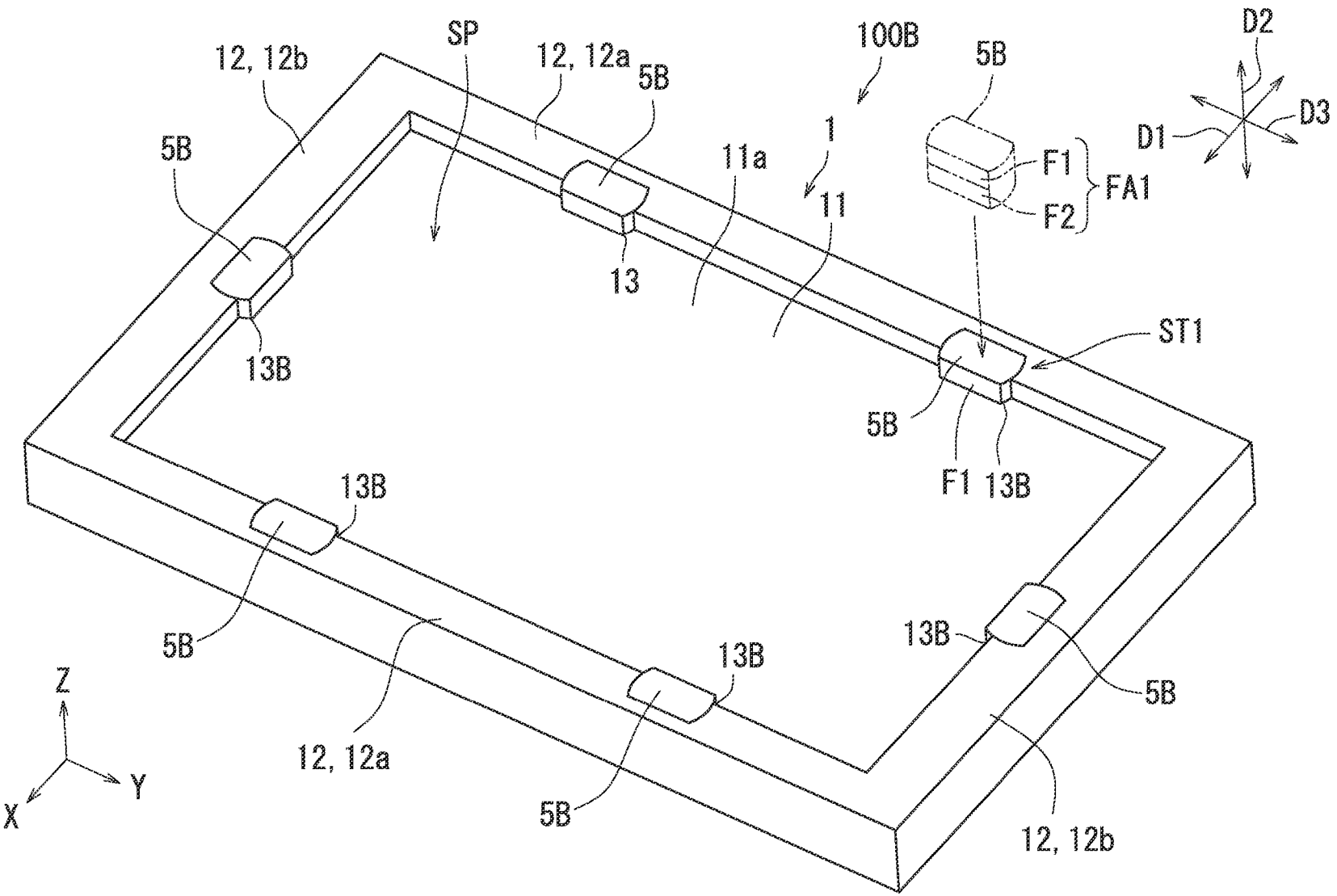
FIG. 14 is a perspective view of a state in which a container according to a second variation of the first embodiment does not accommodate the to-be-accommodated objects.
Figure 15:
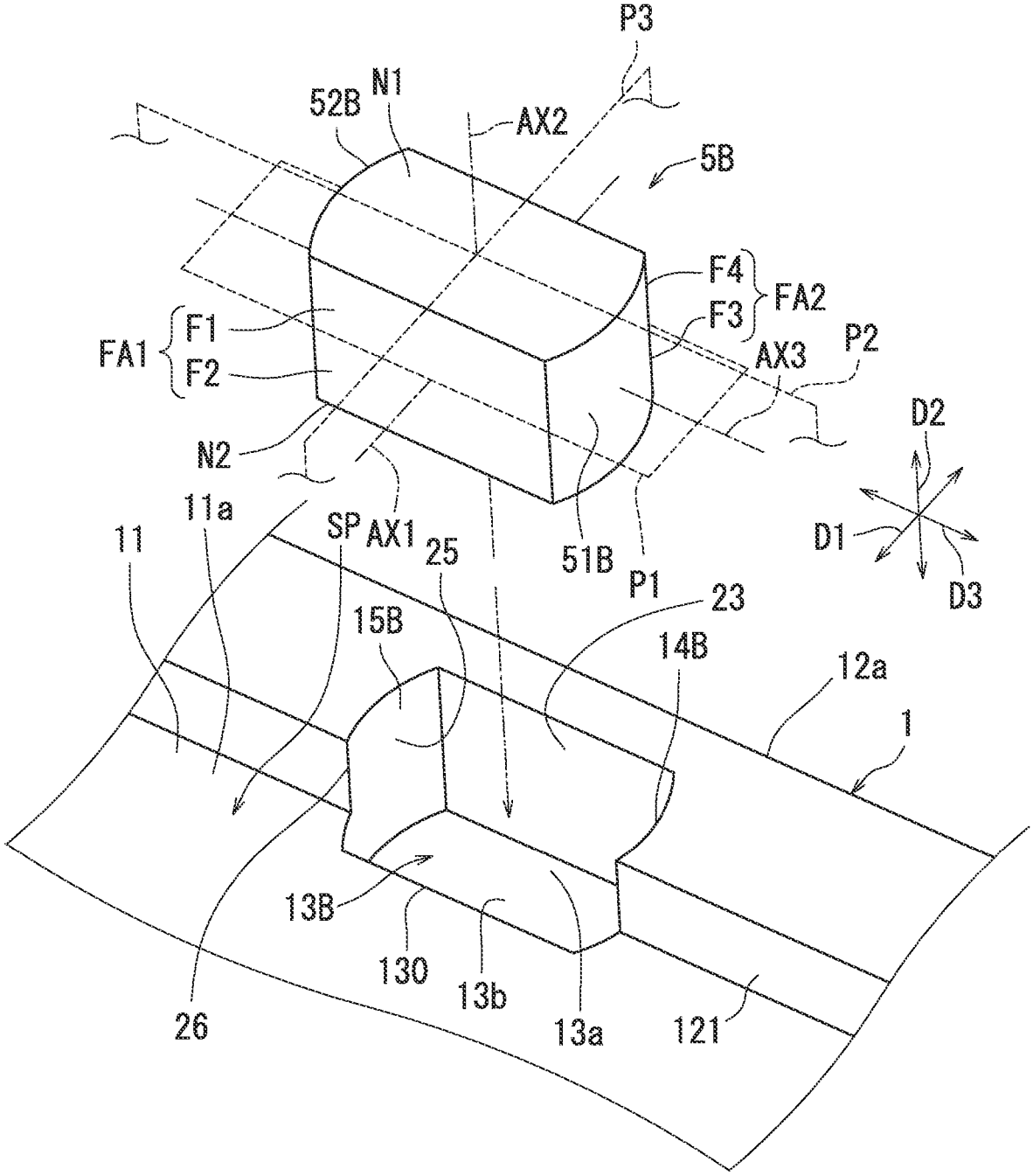
FIG. 15 is a perspective view of a recess in a container main body and a cushioning before being set in the recess according to the second variation.
Figure 16:
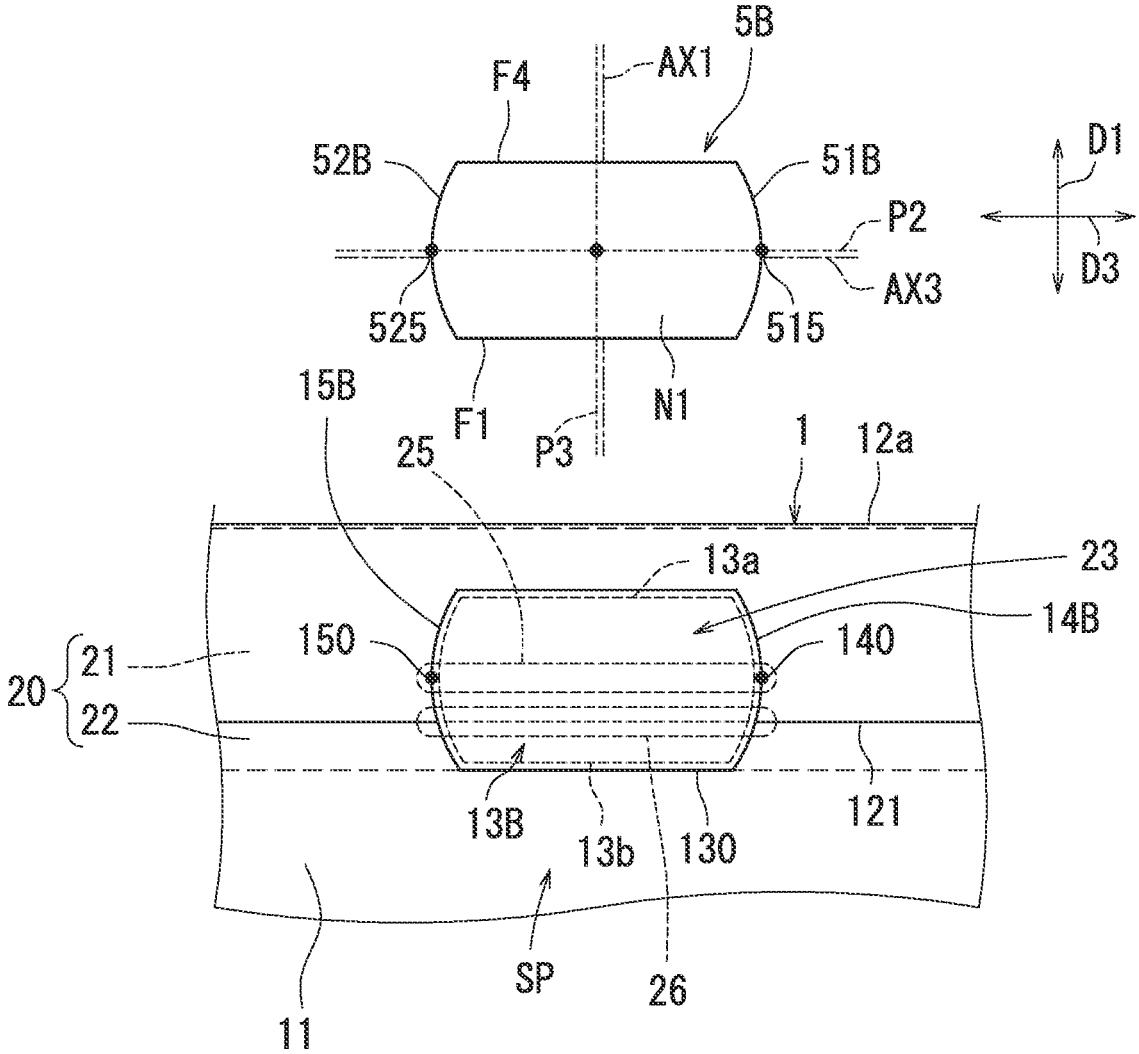
FIG. 16 is a planar view of the recess in the container main body and the cushioning before being set in the recess according to the second variation.
Figure 17:
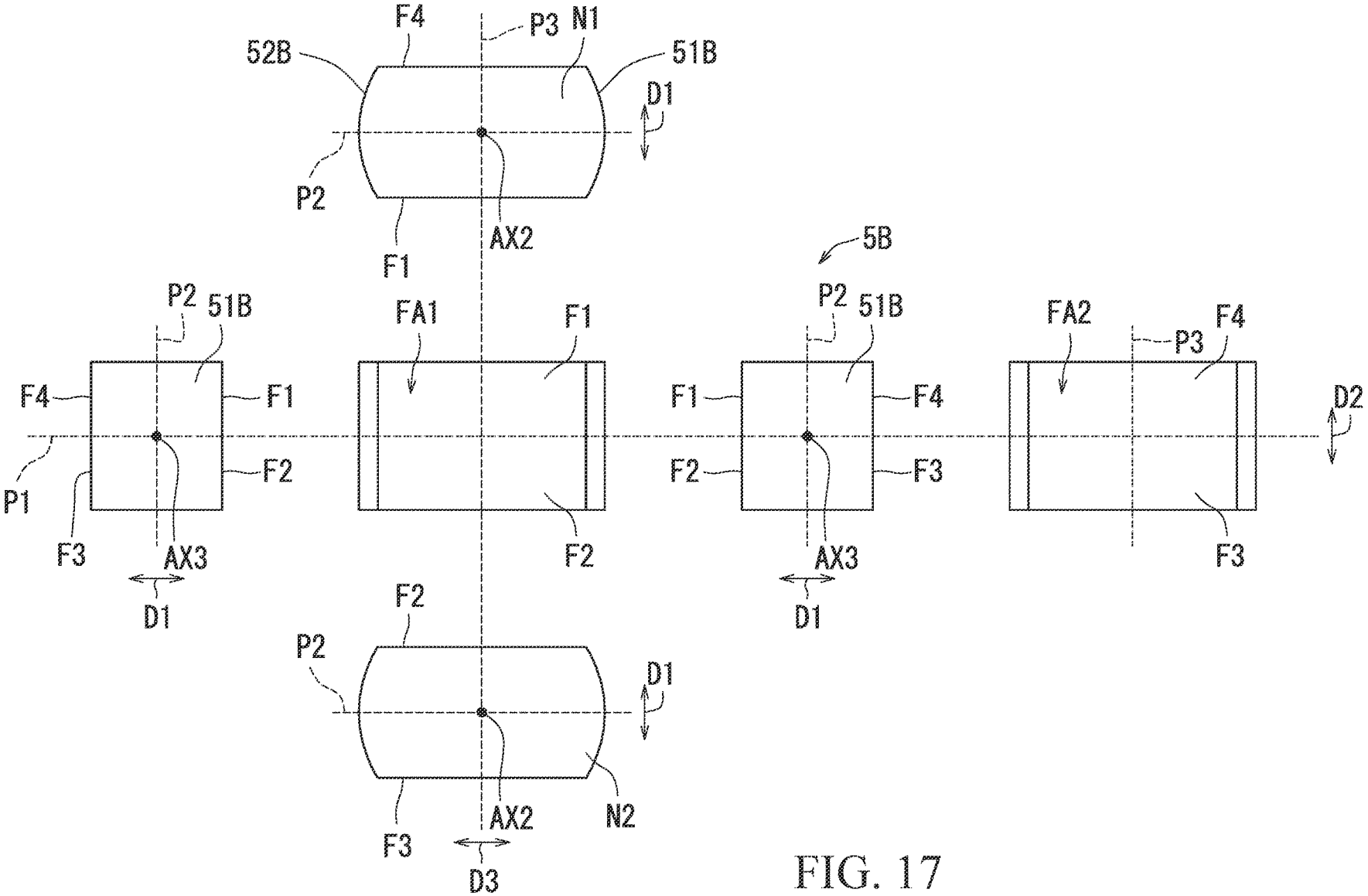
FIG. 17 is a 6-view diagram of the cushioning according to the second variation.

Reuse of the cushioning 5 will be described next with reference to FIGS. 8 and 9. FIG. 8 is a perspective view of the first to fourth postures ST1 to ST4 of the cushioning 5 alone in reuse of the cushioning 5. In FIG. 8, used receiving surfaces are hatched with dots. Furthermore, the boundary between the first receiving surface F1 and the second receiving surface F2 and the boundary between the third receiving surface F3 and the fourth receiving surface F4 are indicated by broken lines for the sake of easy understanding. FIG. 9 is a perspective view of the first to fourth postures ST1 to ST4 of the cushioning 5 in reuse of the cushioning 5.

As illustrated in FIGS. 8 and 9, the first receiving surface F1 is located inward of the side wall 12*a* and faces the accommodation space SP (faces inward in the first direction D1) in the first posture state. In the first posture state, the first receiving surface F1 protrudes upward in the second direction D2 from the recess 13 (is exposed to the accommodation space SP from the recess 13). As such, the first receiving surface F1 serves as a receiving surface for the to-be-accommodated objects PA in the first posture state. Also in the first posture state, the second receiving surface F2 is buried in the recess 13 (located below the surface 11*a* of the base 11), and does not face the accommodation space SP. Furthermore, in the first posture state, the third receiving surface F3 and the fourth receiving surface F4 confront the opposite side to the accommodation space SP and do not face the accommodation space SP. In the first posture state, the third receiving surface F3 and the fourth receiving surface F4 are blocked by the side wall 12*a*.

In the first posture state, the first receiving surface F1 faces the edges EG (FIG. 1) of the to-be-accommodated objects PA when the to-be-accommodated objects PA are accommodated in the container 100. That is, the first receiving surface F1 which may come into contact with the to-be-accommodated objects PA in the first posture state serves as a receiving surface for the to-be-accommodated objects PA. Note that the first fit portion 51 engages with the first main body fit portion 14 and the second fit portion 52 engages with the second main body fit portion 15 in the first posture state.

Once the to-be-accommodated objects PA are transported using the container 100 in the first posture state, protection performance of the first receiving surface F1 having served as a receiving surface for the to-be-accommodated objects PA may be impaired. As such, it is not preferable to reuse the first receiving surface F1 as a receiving surface in second accommodation and transportation of the to-be-accommodated objects PA. In view of the foregoing, the to-be-accommodated objects PA are accommodated anew only after the posture of the cushioning 5 is changed from the first posture ST1 to a posture different from the first posture ST1, for example, the second posture ST2. The second posture ST2 is a posture in which the cushioning 5 in the first posture ST1 is rotated (upside down) by 180 degrees about the first symmetric axis AX1.

Specifically, the second receiving surface F2 is located inward of the side wall 12*a* and faces the accommodation space SP in the second posture state. As such, in the second posture state, the second receiving surface F2 serves as a receiving surface for the to-be-accommodated objects PA. The second receiving surface F2 in the second posture state is the same as the first receiving surface F1 in the first posture state. Also in the second posture state, the first receiving surface F1 is buried in the recess 13 and does not face the accommodation space SP. The first receiving surface F1 in the second posture ST2 is the same as the second receiving surface F2 in the first posture ST1. Furthermore, the third receiving surface F3 and the fourth receiving surface F4 in the second posture state confront the opposite side to the accommodation space SP. The third receiving surface F3 and the fourth receiving surface F4 in the second posture state are respectively the same as the fourth receiving surface F4 and the third receiving surface F3 in the first posture state. Note that in the second posture state, the second fit portion 52 engages with the first main body fit portion 14 and the first fit portion 51 engages with the second main body fit portion 15.

Once the to-be-accommodated objects PA are transported using the container 100 in the second posture state, protection performance of the second receiving surface F2 having served as a receiving surface for the to-be-accommodated objects PA may be impaired. As such, it is not preferable to reuse the second receiving surface F2 as a receiving surface in addition to the first receiving surface F1 in third accommodation and transportation of the to-be-accommodated objects PA. In view of the foregoing, the to-be-accommodated objects PA are accommodated anew only after the posture of the cushioning 5 is changed from the second posture ST2 to a posture different from the first posture ST1 and the second posture ST2, for example, a third posture ST3. The third posture ST3 is a posture in which the cushioning 5 in the second posture ST2 is rotated by 180 degrees about the second symmetric axis AX2.

Specifically, the third receiving surface F3 is located inward of the side wall 12*a* and faces the accommodation space SP in a state in which the cushioning 5 in the third posture ST3 is set in the recess 13 (in the third posture state). In the above configuration, the third receiving surface F3 serves as a receiving surface for the to-be-accommodated objects PA in the third posture state. The third receiving surface F3 in the third posture state is the same as the first receiving surface F1 in the first posture state. Also in the third posture state, the fourth receiving surface F4 is buried in the recess 13 and does not face the accommodation space SP. The fourth receiving surface F4 in the third posture state is the same as the second receiving surface F2 in the first posture state. Furthermore, the first receiving surface F1 and the second receiving surface F2 confront the opposite side to the accommodation space SP in the third posture state. The first receiving surface F1 and the second receiving surface F2 in the third posture state are respectively the same as the third receiving surface F3 and the fourth receiving surface F4 in the first posture state. Note that the first fit portion 51 engages with the first main body fit portion 14 and the second fit portion 52 engages with the second main body fit portion 15 in the third posture state.

Once the to-be-accommodated objects PA are transported using the container 100 in the third posture state, protection performance of the third receiving surface F3 having served as a receiving surface for the to-be-accommodated objects PA may be impaired. As such, it is not preferable to reuse the third receiving surface F3 as a receiving surface in addition to the first receiving surface F1 and the second receiving surface F2 in fourth accommodation and transportation of the to-be-accommodated objects PA. In view of the foregoing, the to-be-accommodated objects PA are accommodated anew only after the posture of the cushioning 5 is changed from the third posture ST3 to a posture different from the first posture ST1, the second posture ST2, and the third posture ST3, for example, a fourth posture ST4. The fourth posture ST4 is a posture in which the cushioning 5 in the third posture ST3 is rotated (upside down) by 180 degrees about the first symmetric axis AX1.

Specifically, the fourth receiving surface F4 is located inward of the side wall 12*a* and faces the accommodation space SP in a state in which the cushioning 5 in the fourth posture ST4 is set in the recess 13 (in a fourth posture state). In the above configuration, the fourth receiving surface F4 serves as a receiving surface for the to-be-accommodated objects PA in the fourth posture state. The fourth receiving surface F4 in the fourth posture state is the same as the first receiving surface F1 in the first posture state. Also in the fourth posture state, the third receiving surface F3 is buried in the recess 13 and does not face the accommodation space SP. The third receiving surface F3 in the fourth posture state is the same as the second receiving surface F2 in the first posture state. Furthermore, the first receiving surface F1 and the second receiving surface F2 in the fourth posture state confront the opposite side to the accommodation space SP. The first receiving surface F1 and the second receiving surface F2 in the fourth posture state are respectively the same as the fourth receiving surface F4 and the third receiving surface F3 in the first posture state. Note that in the fourth posture state, the second fit portion 52 engages with the first main body fit portion 14 and the first fit portion 51 engages with the second main body fit portion 15.

As described above, the cushioning 5 are 180-degree rotationally symmetrical about the first symmetric axis AX1 and 180-degree rotationally symmetrical about the second symmetric axis AX2. In the above configuration, the cushioning 5 can be set in the recess 13 even in any of the four postures ST1 to ST4 that are achieved by rotating the cushioning 5 about the first symmetric axis AX1 or the second symmetric axis AX2 by 180 degrees. The first receiving surface F1 in the first posture state, the second receiving surface F2 in the second posture state, the third receiving surface F3 in the third posture state, and the fourth receiving surface F4 in the fourth posture state each serve as a receiving surface for the to-be-accommodated objects PA. As such, even in repetitive accommodation of the to-be-accommodated objects PA of the same size, the different receiving surfaces can be used each as a receiving surface for the to-be-accommodated objects PA by changing the posture of the cushioning 5 among the first to fourth postures ST1 to ST4 in the container 100 according to the first embodiment. Thus, the cushioning 5 can be reused with its performance maintained. Furthermore, performance of the cushioning 5 can be maintained longer, thereby achieving further reduction in cost of the container 100 (the cushionings 5 and the container main body 1).

First Variation

FIGS. 10 to 13 illustrate a container 100A, recesses 13A, and cushionings 5A according to a first variation of the first embodiment. As illustrated in FIGS. 10 to 13, a first fit portion 51A and a second fit portion 52A of each cushioning 5A may be U-shaped in planar view. In this case also, the cushioning 5A can be inhibited from inclining, displacing, and falling toward the accommodation space SP likewise in the first embodiment 1 in which the first fit portion 51 and the second fit portion 52 are V-shaped in planar view. Note that reuse of the cushioning 5A is the same as the reuse of the cushioning 5 described with reference to FIGS. 8 and 9.

Second Variation

FIGS. 14 to 17 illustrate a container 100B, recesses 13B, and cushionings 5B according to a second variation of the first embodiment. As illustrated in FIGS. 14 to 17, a first fit portion 51B and a second fit portion 52B of each cushioning 5B may have a convex shape protruding outward at the central part between the opposite ends in the first direction D1 thereof. In this case also, the cushioning 5B can be inhibited from inclining, displacing, and falling toward the accommodation space SP likewise in the first embodiment in which the first fit portion 51 and the second fit portion 52 have a recessed shape. Note that reuse of the cushioning 5B is the same as the reuse of the cushioning 5 described with reference to FIGS. 8 and 9.

Second Embodiment

With reference to FIGS. 18 to 23, a container 100C according to a second embodiment of the present disclosure will be described. The second embodiment mainly differs from the first embodiment, which provides four receiving surfaces for the to-be-accommodated objects PA, in that cushionings 5C in the second embodiment each have eight receiving surfaces for the to-be-accommodated objects PA. The following mainly describes the differences of the second embodiment from the first embodiment.

Figure 18:
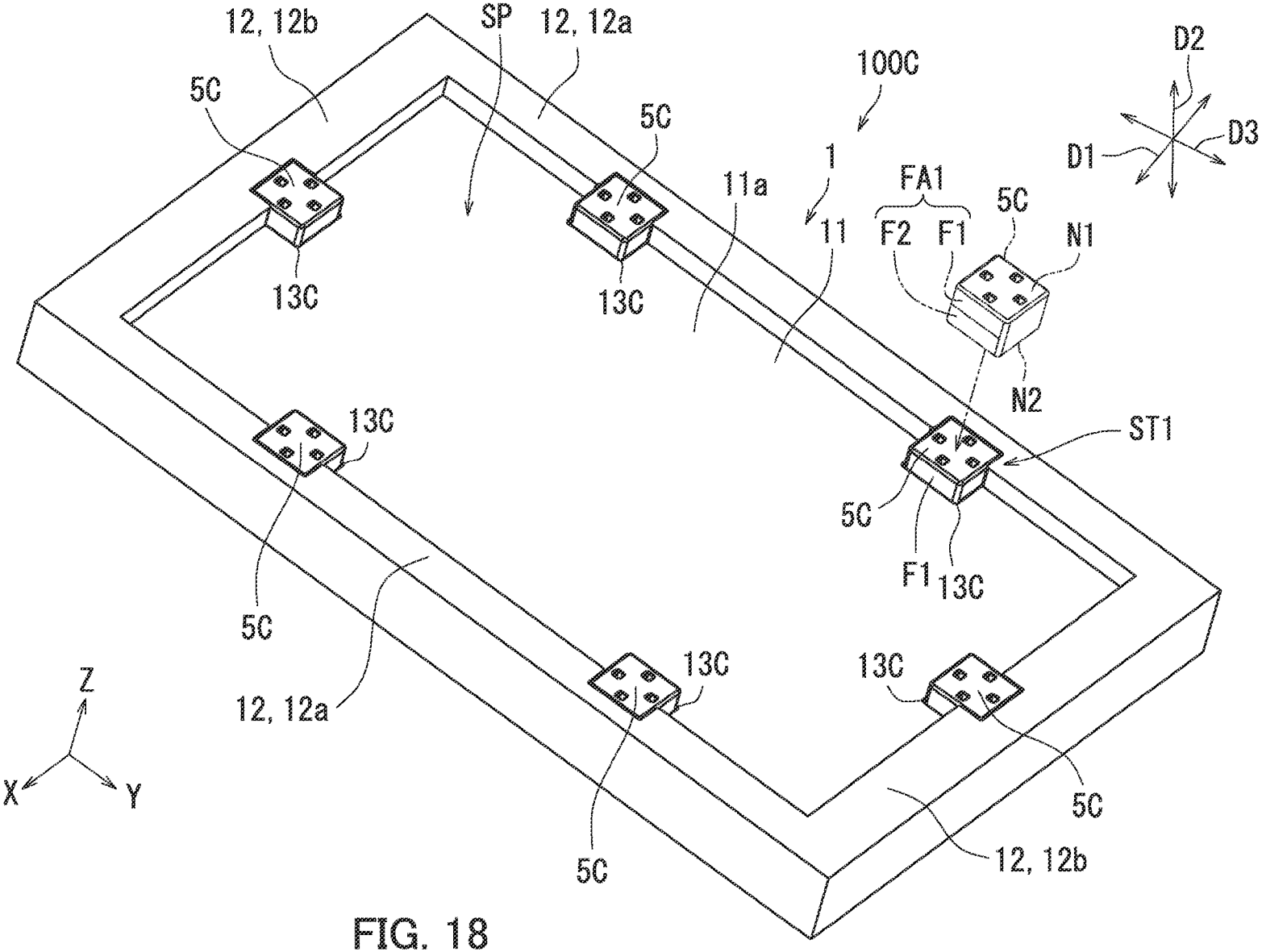
FIG. 18 is a perspective view of a state in which a container according to a second embodiment of the present disclosure does not accommodate the to-be-accommodated objects.

As illustrated in FIG. 18, the container 100C includes a container main body 1 and one or more (6 in the present embodiment) cushionings 5C. In the example illustrated in FIG. 18, the cushionings 5C have a substantially rectangular parallelepiped shape. The cushionings 5C are elastic and protect the to-be-accommodated objects PA. The container main body 1 includes a base 11, a plurality of side walls 12, and one or more (6 in the present embodiment) recesses 13C. The cushionings 5C are set in the recesses 13C in the container main body 1. The recesses 13C are recessed from a surface 11*a* of the base 11.

The cushionings 5C each have a first receiving surface F1 and a second receiving surface F2. The first receiving surface F1 is located inward of the side walls 12 and face the accommodation space SP in a state (the first posture state) in which the cushionings 5C in a first posture ST1 are set in the recesses 13C. The second receiving surface F2 is buried in the recess 13C in the first posture state. Note that although details will be described later, the cushionings 5C each have a first non-receiving surface N1 and a second non-receiving surface N2.

Figure 19:
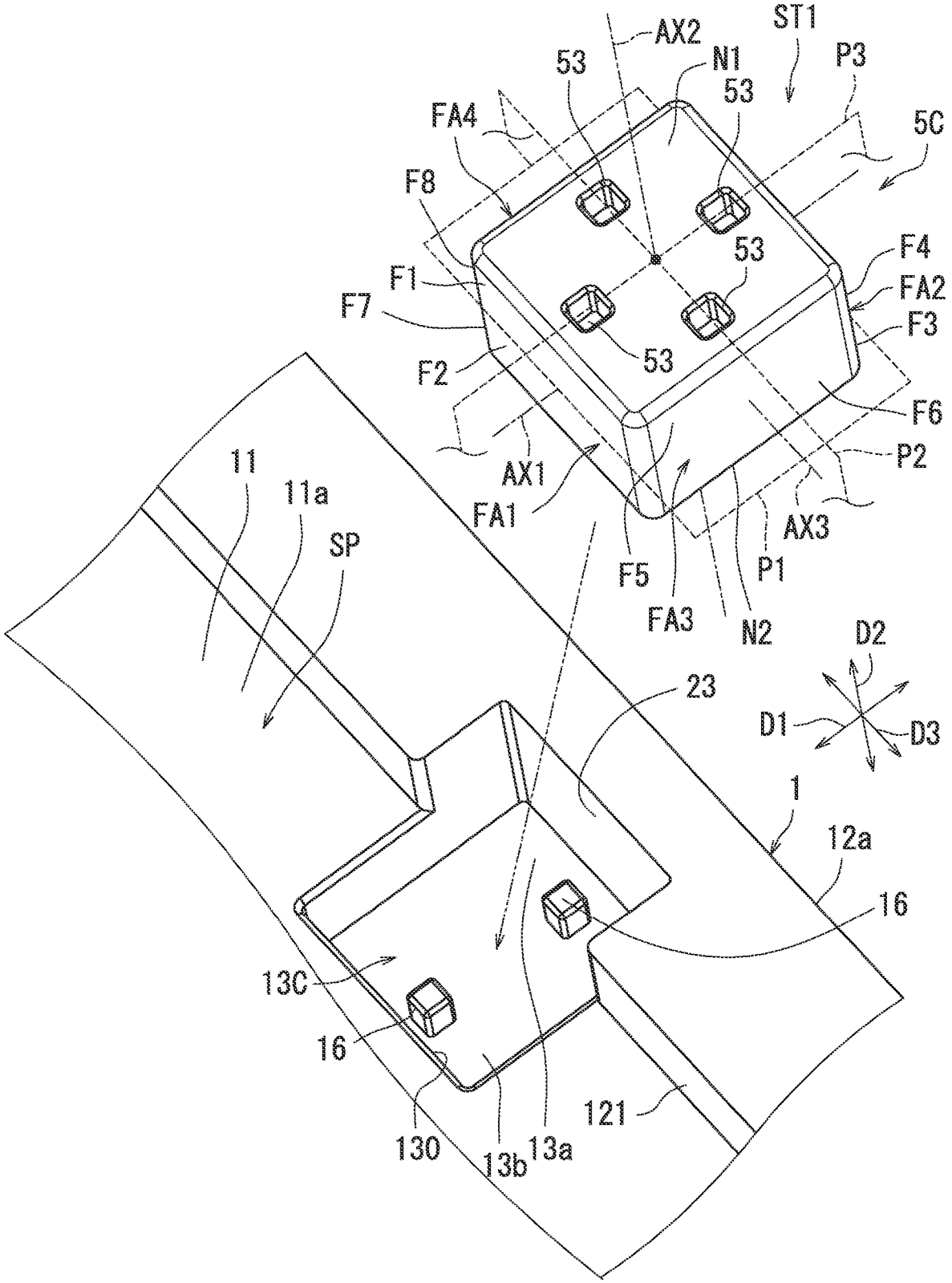
FIG. 19 is a perspective view of a recess in a container main body and a cushioning before being set in the recess according to the second embodiment.
Figure 20:
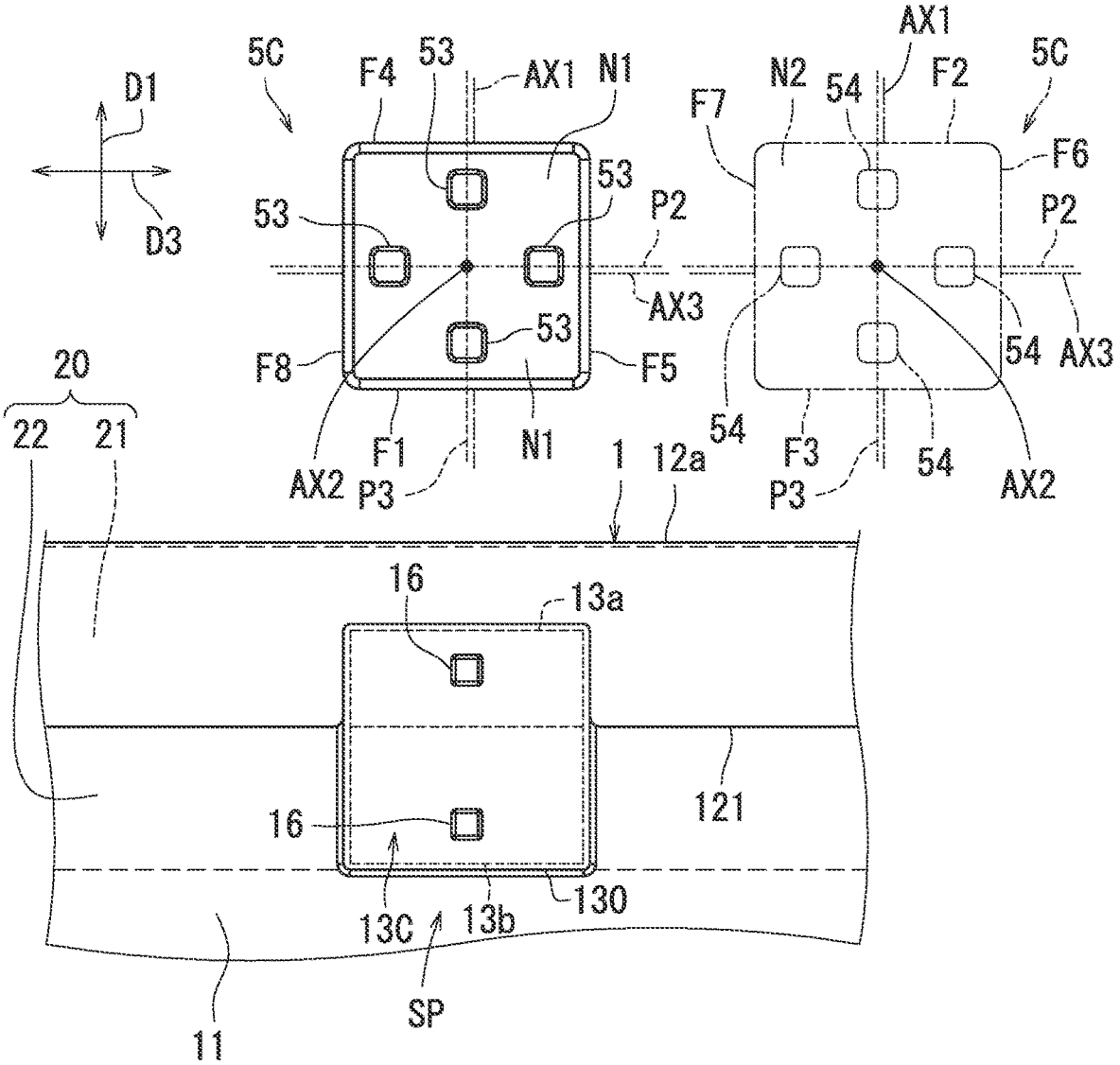
FIG. 20 is a planar view of the recess in the container main body and the cushioning before being set in the recess according to the second embodiment.

FIG. 19 is a perspective view of a recess 13C in the container main body 1 and a cushioning 5C before being set in the recess 13C. FIG. 20 is a planar view of the recess 13C in the container main body 1 and the cushioning 5C before being set in the recess 13C. FIGS. 19 and 20 illustrate a case in which the cushioning 5C in the first posture ST1 is set in the recess 13C. Furthermore, the second non-receiving surface N2, which is the opposite surface to the first non-receiving surface N1, is indicated by a two-dot chain lines along with the first non-receiving surface N1 of the cushioning 5C in FIG. 20 for the sake of easy understanding.

As illustrated in FIGS. 19 and 18, the recess 13C is recessed toward the back surface of the base 11 from the surface 11*a* of the base 11 along the second direction D2. Furthermore, the recess 13C may be formed in an area overlapping a corresponding side wall 12*a* in planar view. The recess 13C includes a first portion 13*a* and a second portion 13*b*.

The cushioning 5C is 180-degree rotationally symmetrical (twice symmetrical) about the first symmetric axis AX1. Furthermore, the cushioning 5C is 90° rotationally symmetrical (four-time symmetrical) about the second symmetric axis AX2. Furthermore, the cushioning 5C is 180-degree rotationally symmetrical (twice symmetrical) about the third symmetric axis AX3. The cushioning 5C has a shape symmetrical with respect to the first plane P1. The shape of the cushioning 5C is also symmetrical with respect to the second plane P2. The shape of the cushioning 5C is also symmetrical with respect to the third plane P3. The first plane P1 corresponds to an example of a "specific plane" in the present disclosure.

The cushioning 5C includes one or more fifth fit portions 53 and one or more sixth fit portions 54 (FIG. 20). In the second embodiment, the cushioning 5C includes a plurality of (4 in the example illustrated in FIG. 20) fifth fit portions 53 and a plurality of (4 in the example illustrated in FIG. 20) sixth fit portions 54. In the second embodiment, the number of the fifth fit portions 53 is equal to the number of the sixth fit portions 54. The fifth fit portions 53 and the sixth fit portions 54 have the following features for example in the first posture state.

That is, the fifth fit portions 53 and the sixth fit portions 54 have a shape symmetrical with respect to the first plane P1. The fifth fit portions 53 are symmetrical with respect to the second plane P2. The sixth fit portions 54 are symmetrical with respect to the second plane P2. The fifth fit portions 53 are symmetrical with respect to the third plane P3. The sixth fit portions 54 are symmetrical with respect to the third plane P3.

The fifth fit portions 53 are 90-degree rotationally symmetrical about the second symmetric axis AX2. The fifth fit portions 53 are arranged in the first non-receiving surface N1. The first non-receiving surface N1 is a surface of the cushioning 5C at one end in the second direction D2 thereof. That is, the fifth fit portions 53 are located at one end of the cushioning 5C in the second direction D2. The fifth fit portions 53 are arranged at regular intervals in the peripheral direction about the second symmetric axis AX2. Note that a fifth fit portion 53 may be provided in the central part (overlapping the second symmetric axis AX2) of the first non-receiving surface N1.

The sixth fit portions 54 are 90-degree rotationally symmetrical about the second symmetric axis AX2. The sixth fit portions 54 are arranged in the second non-receiving surface N2. The second non-receiving surface N2 is a surface of the cushioning 5C at the other end in the second direction D2 thereof. That is, the sixth fit portions 54 are located at the other end of the cushioning 5C in the second direction D2. The sixth fit portions 54 are arranged at regular intervals in the peripheral direction about the second symmetric axis AX2. Note that a sixth fit portion 54 may be provided in the central part (overlapping the second symmetric axis AX2) of the second non-receiving surface N2.

The fifth fit portions 53 and the sixth fit portions 54 are holes in the second embodiment. For example, the fifth fit portions 53 and the sixth fit portions 54 are rectangular parallelepiped or cubic holes. Furthermore, the fifth fit portions 53 are provided in correspondence with the sixth fit portions 54. The fifth fit portions 53 are located on the opposite side to the corresponding sixth fit portions 54 in the second direction D2. The fifth fit portions 53 and the corresponding sixth fit portions 54 are recessed toward each other in the second direction D2.

The recess 13C has one or more base fit portions 16. The recess 13C includes a plurality (2 in the example illustrated in FIG. 20) of base fit portions 16 in the second embodiment. The number of the base fit portions 16 is ½ of the number of the fifth fit portions 53.

The base fit portions 16 are provided at the bottom of the recess 13C. Specifically, one of the base fit portions 16 is located at the bottom of the first portion 13*a* and the other base fit portion 16 is located at the bottom of the second portion 13*b*. The one base fit portion 16 and the other base fit portion 16 are separate from each other in the first direction D1 and opposite to each other in the first direction D1.

The base fit portions 16 are protrusions protruding along the second direction D2 from the bottom of the recess 13C. The base fit portions 16 are symmetrical with each other with respect to the second plane P2. The base fit portions 16 are symmetrical with each other with respect to the third plane P3.

The base fit portions 16 are to be fitted to either the fifth fit portions 53 or the sixth fit portions 54 according to the posture of the cushioning 5C set in the recess 13C. In the above configuration according to the second embodiment, the cushioning 5C can be inhibited from inclining, displacing, and falling toward the accommodation space SP. As a result, damage such as cracking in the to-be-accommodated objects PA can be inhibited from occurring for example upon an automatic machine accommodating the to-be-accommodated objects PA into the container 100C.

The surfaces of the cushioning 5C will be described next with reference to FIGS. 19 and 21. As illustrated in FIG. 19, the cushioning 5C has a first surface FA1, a second surface FA2 located on the opposite side to the first surface FA1, a third surface FA3, a fourth surface located on the opposite side to the third surface FA3, a first non-receiving surface N1, and a second non-receiving surface N2 located on the opposite side to the first non-receiving surface N1. The first surface FA1 and the second surface FA2 are respectively the same as the first surface FA1 and the second surface FA2 in the first embodiment. The third surface FA3 includes a fifth receiving surface F5 and a sixth receiving surface F6. The third surface FA3 connects one end of the first surface FA1 in the third direction D3 to one end of the second surface FA2 in the third direction D3. The fourth surface FA4 includes a seventh receiving surface F7 and an eighth receiving surface F8. The fourth surface FA4 connects the other end of the first surface FA1 in the third direction D3 to the other end of the second surface FA2 in the third direction D3. The third surface FA3 and the fourth surface FA4 are located opposite each other with the first symmetric axis AX1 therebetween. The third surface FA3 and the fourth surface FA4 are located on the opposite sides to each other with the second symmetric axis AX2 therebetween.

Figure 21:
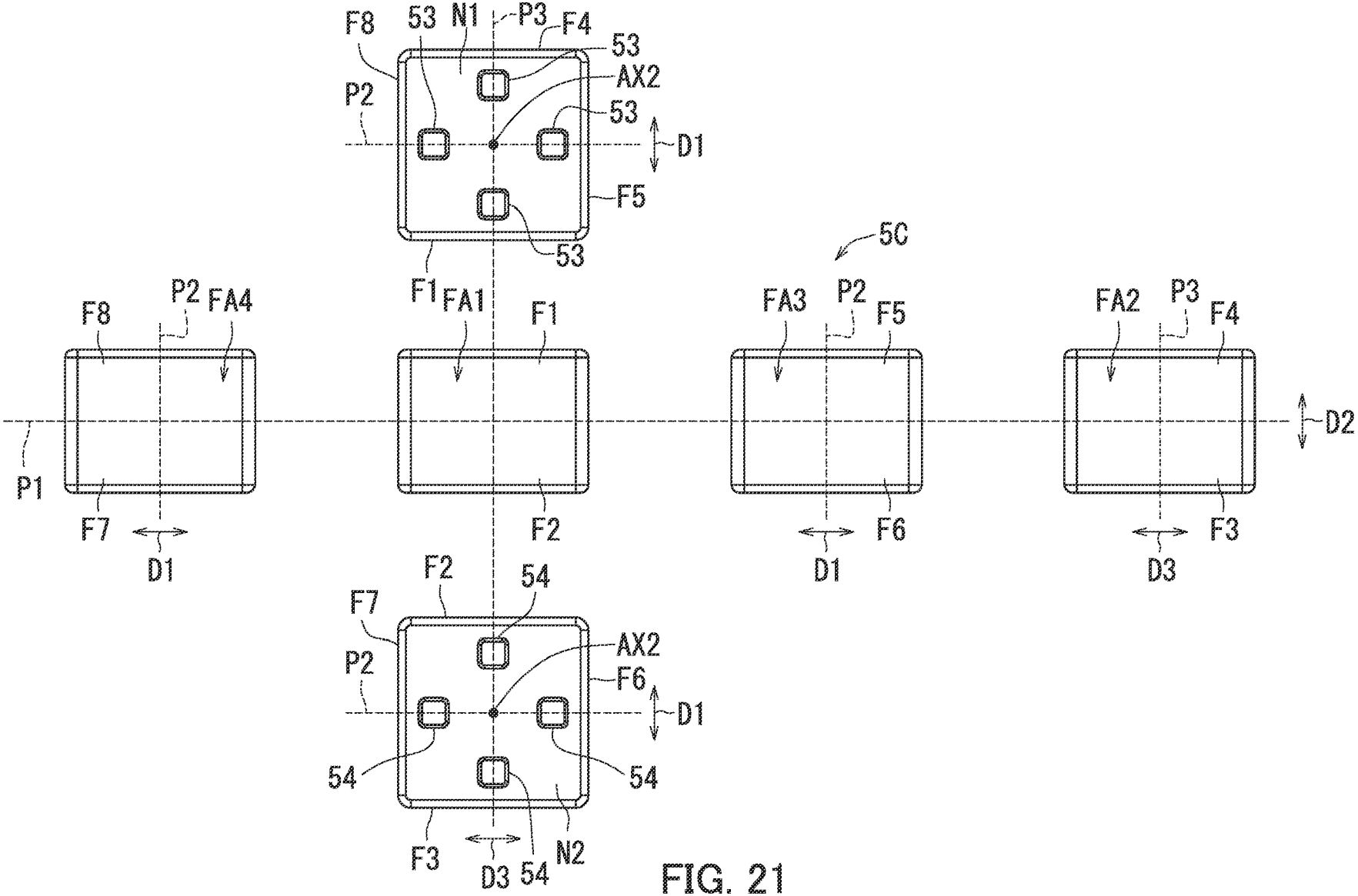
FIG. 21 is a 6-view diagram of the cushioning according to the second embodiment.

FIG. 21 is an orthographic projection of the cushioning 5C as viewed in six directions. FIG. 21 indicates the first to third directions D1 to D3 and the first to third planes P1 to P3 in the first posture state. As illustrated in FIG. 21, the first to fourth receiving surfaces F1 to F4, the first non-receiving surface N1, and the second non-receiving surface N2 are respectively the same as the first to fourth receiving surfaces F1 to F4, the first non-receiving surface N1, and the second non-receiving surface N2 described with reference to FIG. 7, and therefore, description thereof is omitted.

The fifth receiving surface F5 connects one end of the first receiving surface F1 in the third direction D3 to one end of the fourth receiving surface F4 in the third direction D3. The sixth receiving surface F6 connects one end of the second receiving surface F2 in the third direction D3 to one end of the third receiving surface F3 in the third direction D3. The fifth receiving surface F5 and the sixth receiving surface F6 are located side by side in the second direction D2 on the same plane. The fifth receiving surface F5 and the sixth receiving surface F6 are symmetrical with each other with respect to the first plane P1.

The seventh receiving surface F7 connects the other end of the second receiving surface F2 in the third direction D3 to the other end of the third receiving surface F3 in the third direction D3. The eighth receiving surface F8 connects the other end of the first receiving surface F1 in the third direction D3 to the other end of the fourth receiving surface F4 in the third direction D3. The seventh receiving surface F7 and the eighth receiving surface F8 are located side by side in the second direction D2 on the same plane. The seventh receiving surface F7 and the eighth receiving surface F8 are symmetrical with each other with respect to the first plane P1. Note that each of the first to fourth surfaces FA1 to FA4 and each of the first to the eighth receiving surfaces F1 to F8 are planar in the example illustrated in FIG. 21.

Figure 22:
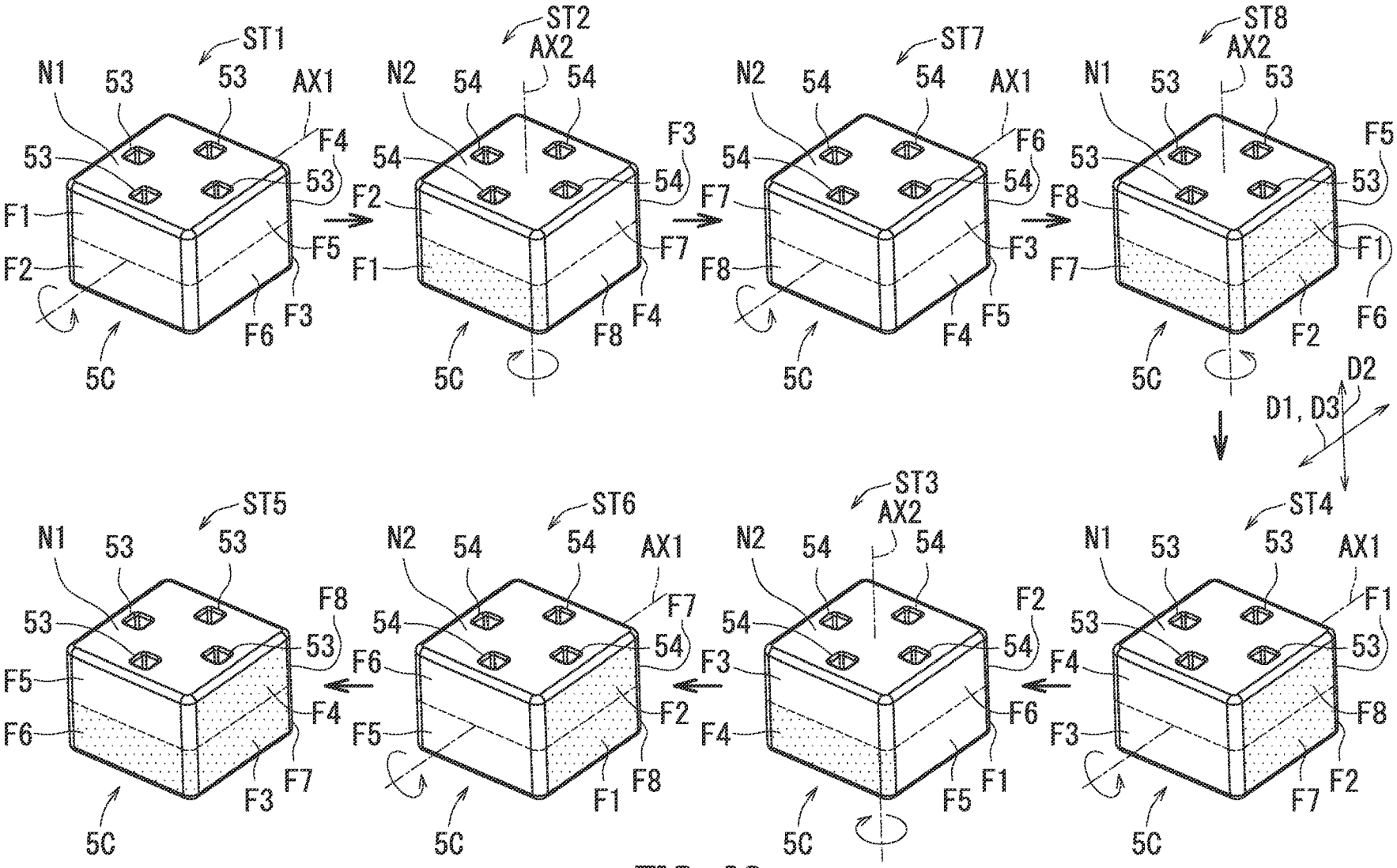
FIG. 22 is a perspective view of first to eighth postures of the cushioning according to the second embodiment alone in a case in which the cushioning is reused.
Figure 23:
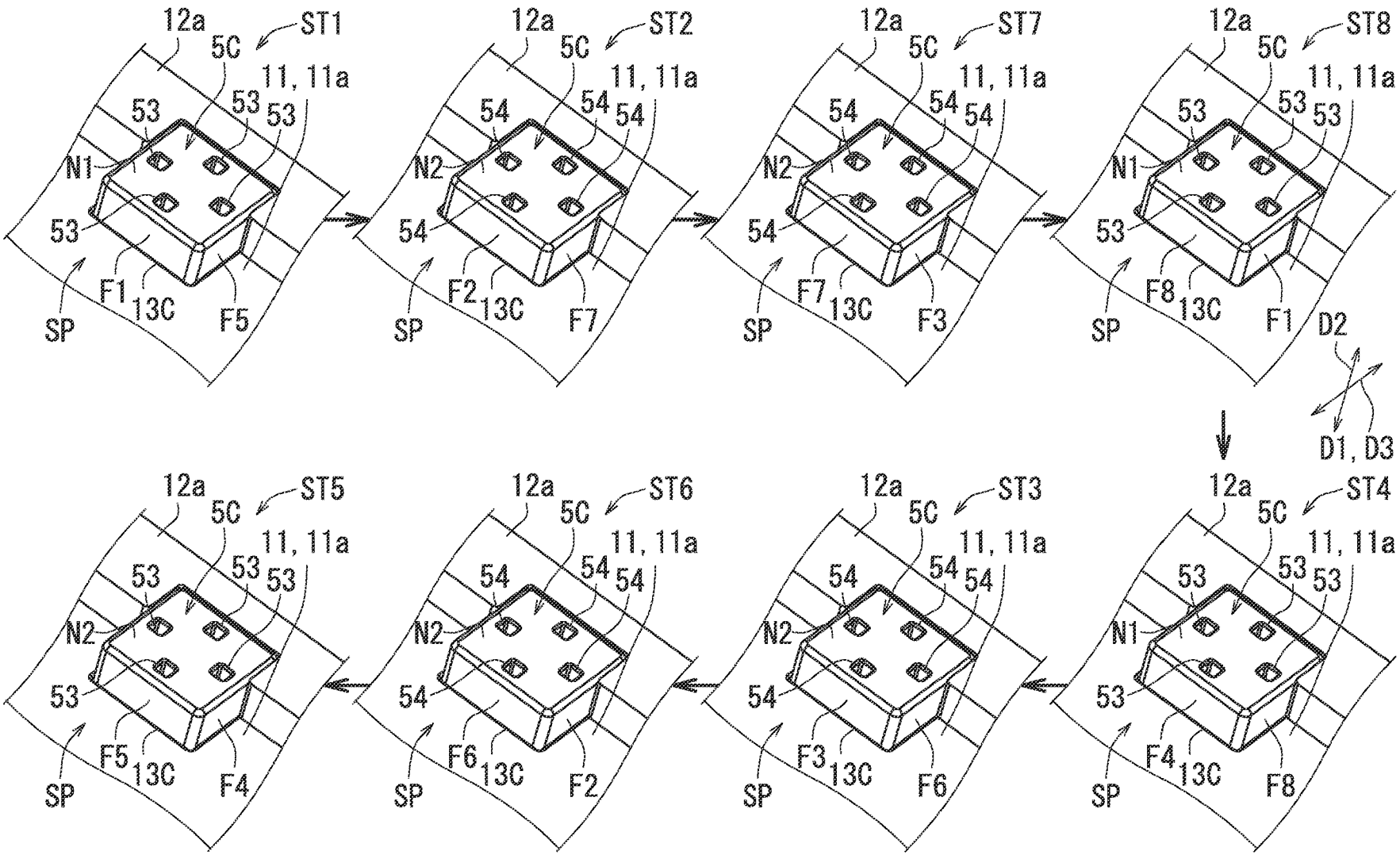
FIG. 23 is a perspective view of the first to eighth postures of the cushioning according to the second embodiment in a case in which the cushioning is reused.
Figure 24:
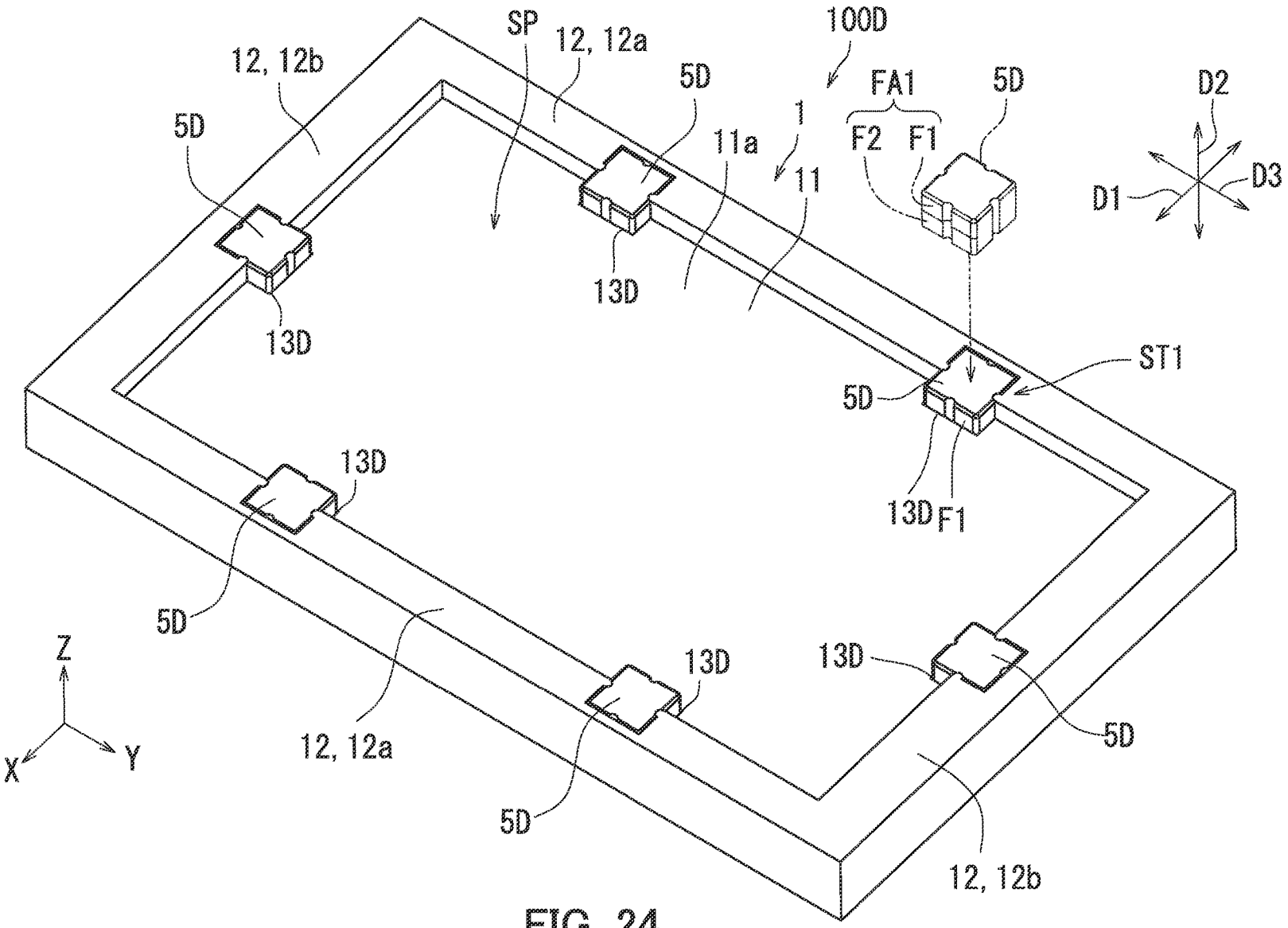
FIG. 24 is a perspective view of a state in which a container according to a variation of the second embodiment does not accommodate the to-be-accommodated objects.

Reuse of the cushioning 5C will be described next with reference to FIGS. 22 and 23. FIG. 22 is a perspective view of the first to eighth postures ST1 to TS8 of the cushioning 5C alone in reuse of the cushioning 5C. In FIG. 22, used surfaces are hatched with dots. Furthermore, the boundaries are indicated by broken lines for the sake of understanding. FIG. 23 is a perspective view of the first to eighth postures ST1 to ST8 of the cushioning 5C in reuse of the cushioning 5C.

Note that in the second embodiment, the first direction D1 is a direction substantially perpendicular to the inner surface 121 of the side wall 12*a* and the third direction D3 is a direction substantially in parallel to the surface 11*a* of the base 11 and the direction in which the side wall 12*a* extends in a state in which the cushioning 5 in the first posture ST1, the second posture ST2, the third posture ST3, or the fourth posture ST4C is set in the recess 13C. By contrast, in a state in which the cushioning 5C in the fifth posture ST5, the sixth posture ST6, the seventh posture ST7, or the eighth posture ST8 is set in the recess 13C, the first direction D1 is a direction substantially in parallel to the surface 11*a* of the base 11 and the direction in which the side wall 12*a* extends, and the third direction D3 is a direction substantially perpendicular to the inner surface 121 of the side wall 12*a*.

The locations of the first receiving surface F1, the second receiving surface F2, the third receiving surface F3, and the fourth receiving surface F4 in the first posture state is the same as those illustrated in FIGS. 8 and 9. As illustrated in FIGS. 22 and 23, the first receiving surface F1 is located inward of the side wall 12*a* and faces the accommodation space SP in the first posture state. As such, the first receiving surface F1 serves as a receiving surface for the to-be-accommodated objects PA in the first posture state. Also in the first posture state, the second receiving surface F2 is buried in the recess 13C and does not face the accommodation space SP. Furthermore, the third receiving surface F3 and the fourth receiving surface F4 confront the opposite side to the accommodation space SP in the first posture state.

Furthermore, in the first posture state, the fifth to eighth receiving surfaces F5 to F8 face in the direction in which the side wall 12*a* extends. As such, the fifth to eighth receiving surfaces F5 to F8 do not serve as a receiving surface for the to-be-accommodated objects PA. Note that two of the sixth fit portions 54 are fitted to the base fit portions 16 in the first posture state.

Once the to-be-accommodated objects PA are transported using the container 100C in the first posture state, protection performance of the first receiving surface F1 having served as a receiving surface for the to-be-accommodated objects PA may be impaired. As such, it is not preferable to reuse the first receiving surface F1 as a receiving surface in second accommodation and transportation of the to-be-accommodated objects PA. In view of the foregoing, the to-be-accommodated objects PA are accommodated anew only after the posture of the cushioning 5C is changed from the first posture ST1 to a posture different from the first posture ST1, for example, the second posture ST2. The second posture ST2 is a posture in which the cushioning 5C in the first posture ST1 is rotated by 180 degrees about the first symmetric axis AX1 (rotated upside down).

Specifically, the second receiving surface F2 is located inward of the side wall 12*a* and faces the accommodation space SP in a state (the second posture state) in which the cushioning 5C in the second posture ST2 is set in the recess 13C. As such, the second receiving surface F2 serves as a receiving surface for the to-be-accommodated objects PA in the second posture state. The second receiving surface F2 in the second posture state is the same as the first receiving surface F1 in the first posture state. Also in the second posture state, the first receiving surface F1 is buried in the recess 13C and does not face the accommodation space SP. The first receiving surface F1 in the second posture state is the same as the second receiving surface F2 in the first posture state.

Furthermore, the third receiving surface F3 and the fourth receiving surface F4 confront the opposite side to the accommodation space SP in the second posture state. The third receiving surface F3 and the fourth receiving surface F4 in the second posture state are respectively the same as the fourth receiving surface F4 and the third receiving surface F3 in the first posture state. Furthermore, in the second posture state, the fifth to eighth receiving surfaces F5 to F8 face in the direction in which the side wall 12*a* extends. Note that two of the fifth fit portions 53 are fitted to the base fit portions 16 in the second posture state.

Once the to-be-accommodated objects PA are transported using the container 100C in the second posture state, protection performance of the second receiving surface F2 having served as a receiving surface for the to-be-accommodated objects PA may be impaired. As such, it is not preferable to reuse the second receiving surface F2 as a receiving surface in addition to the first receiving surface F1 in third accommodation and transportation of the to-be-accommodated objects PA1. In view of the foregoing, the to-be-accommodated objects PA are accommodated anew only after the posture of the cushioning 5C is changed from the second posture ST2 to a posture different from the first posture ST1 and the second posture ST2, for example, the seventh posture ST7. The seventh posture ST7 is a posture in which the cushioning 5C in the second posture ST2 is rotated (clockwise) by 90 degrees about the second symmetric axis AX2.

Specifically, the seventh receiving surface F7 is located inward of the side wall 12*a* and faces the accommodation space SP in a state (the seventh posture state) in which the cushioning 5C in the seventh posture ST7 is set in the recess 13C. As such, the seventh receiving surface F7 serves as a receiving surface for the to-be-accommodated objects PA in the seventh posture state. The seventh receiving surface F7 in the seventh posture state is the same as the first receiving surface F1 in the first posture state. Also in the seventh posture state, the eighth receiving surface F8 is buried in the recess 13C and does not face the accommodation space SP. The eighth receiving surface F8 in the seventh posture state is the same as the second receiving surface F2 in the first posture state.

Furthermore, the fifth receiving surface F5 and the sixth receiving surface F6 confront the opposite side to the accommodation space SP in the seventh posture state. The fifth receiving surface F5 and the sixth receiving surface F6 in the seventh posture state are respectively the same as the third receiving surface F3 and the fourth receiving surface F4 in the first posture state. Furthermore, in the seventh posture state, the first to fourth receiving surfaces F1 to F4 face in the direction in which the side wall 12*a* extends. Note that two of the fifth fit portions 53 are fitted to the base fit portions 16 in the seventh posture state.

Once the to-be-accommodated objects PA are transported using the container 100C in the seventh posture state, protection performance of the seventh receiving surface F7 having served as a receiving surface for the to-be-accommodated objects PA may be impaired. As such, it is not preferable to reuse the seventh receiving surface F7 as a receiving surface in addition to the first receiving surface F1 and the second receiving surface F2 in fourth accommodation and transportation of the to-be-accommodated objects PA. In view of the foregoing, the to-be-accommodated objects PA are accommodated anew only after the posture of the cushioning 5C is changed from the seventh posture ST7 to a posture different from the first posture ST1, the second posture ST2, and the seventh posture ST7, for example, the eighth posture ST8. The eighth posture ST8 is a posture in which the cushioning 5C in the seventh posture ST7 is rotated (upside down) by 180 degrees about the third symmetric axis AX3. Note that the eighth posture ST8 can be also achieved by rotating the cushioning 5C in the seventh posture ST7 by 180 degrees about the first symmetric axis AX1 and then rotating it by 180 degrees about the second symmetric axis AX2.

Specifically, the eighth receiving surface F8 is located inward of the side wall 12*a* and faces the accommodation space SP in a state (the eighth posture state) in which the cushioning 5C in the eighth posture ST8 is set in the recess 13C. As such, the eighth receiving surface F8 serves as a receiving surface for the to-be-accommodated objects PA in the eighth posture state. The eighth receiving surface F8 in the eighth posture state is the same as the first receiving surface F1 in the first posture state. Also in the eighth posture state, the seventh receiving surface F7 is buried in the recess 13C and does not face the accommodation space SP. The seventh receiving surface F7 in the eighth posture state is the same as the second receiving surface F2 in the first posture state.

Furthermore, the fifth receiving surface F5 and the sixth receiving surface F6 confront the opposite side to the accommodation space SP in the eighth posture state. The fifth receiving surface F5 and the sixth receiving surface F6 in the eighth posture state are respectively the same as the third fourth surface F4 and the third receiving surface F3 in the first posture state. Furthermore, the first to fourth receiving surfaces F1 to F4 in the eighth posture state face in the direction in which the side wall 12*a* extends. Note that two of the sixth fit portions 54 in the eighth posture state are fitted to the base fit portions 16.

Thereafter, as well as above, in still other accommodation and transportation of the to-be-accommodated objects PA, the posture of the cushioning 5C is changed to a posture that has not been taken yet. This is because a surface used as a receiving surface for the to-be-accommodated objects PA among the receiving surfaces F1 to F8 may be impaired in protection performance. In the examples illustrated in FIGS. 22 and 23, the posture of the cushioning 5C is changed from the eighth posture ST8 to for example the fourth posture ST4, which has not been taken yet, for transportation of the to-be-accommodated objects PA. The fourth posture ST4 is a state in which the cushioning 5C in the eighth posture ST8 is rotated (anticlockwise) by 90 degrees about the second symmetric axis AX2. In a state (the fourth posture state) in which the cushioning 5C in the fourth posture ST4 is set in the recess 13C, the fourth receiving surface F4 serves as a receiving surface for the to-be-accommodated objects PA.

Next, the posture of the cushioning 5C is changed from the fourth posture ST4 to for example the third posture ST3, which has not been taken yet, for transportation of the to-be-accommodated objects PA. The third posture ST3 is a state in which the cushioning 5C in the fourth posture ST4 is rotated (upside down) by 180 degrees about the first symmetric axis AX1. In a state (the third posture state) in which the cushioning 5C in the third posture ST3 is set in the recess 13C, the third receiving surface F3 serves as a receiving surface for the to-be-accommodated objects PA.

Next, the posture of the cushioning 5C is changed from the third posture ST3 to for example the sixth posture ST6, which has not been taken yet, for transportation of the to-be-accommodated objects PA. The sixth posture ST6 is a state in which the cushioning 5C in the third posture ST3 is rotated (clockwise) by 90 degrees about the second symmetric axis AX2. In a state (the sixth posture state) in which the cushioning 5C in the sixth posture ST6 is set in the recess 13C, the sixth receiving surface F6 serves as a receiving surface for the to-be-accommodated objects PA.

Next, the posture of the cushioning 5C is changed from the sixth posture ST6 to for example the fifth posture ST5, which has not been taken yet, for transportation of the to-be-accommodated objects PA. The fifth posture ST5 is a state in which the cushioning 5C in the sixth posture ST6 is rotated (upside down) by 180 degrees about the third symmetric axis AX3. Note that the fifth posture ST5 can be also achieved by rotating the cushioning 5C in the sixth posture ST6 by 180 degrees about the first symmetric axis AX1 and then rotating it by 180 degrees about the second symmetric axis AX2. In a state (the fifth posture state) in which the cushioning 5C in the fifth posture ST5 is set in the recess 13C, the fifth receiving surface F5 serves as a receiving surface for the to-be-accommodated objects PA.

As described above, the cushioning 5C is 180-degree rotationally symmetrical about the first symmetric axis AX1 and 90-degree rotationally symmetrical about the second symmetric axis AX2. In the above configuration, the cushioning 5C can be set in the recess 13C when being in any of the eight postures ST1 to ST8 that can be achieved by either or both 180-degree rotation of the cushioning 5C about the first symmetric axis AX1 and 90-degree rotation thereof about the second symmetric axis AX2. Each of the first to eighth receiving surfaces F1 to F8 in corresponding one of the first to eighth posture states serves as a receiving surface for the to-be-accommodated objects PA. As such, even in a case in which the to-be-accommodated objects PA of the same size are accommodated in a repetitive manner, the different receiving surfaces can be each used as a receiving surface for the to-be-accommodated objects PA by changing the posture of the cushioning 5C among the first to eighth postures ST1 to ST8 in the container 100C according to the second embodiment. Thus, the cushioning 5C can be reused with its performance maintained. Furthermore, performance of the cushioning 5C can be maintained longer, thereby achieving further reduction in cost of the container 100C (the cushionings 5C and the container main body 1).

Variations

FIGS. 24 to 27 illustrate a container 100D, recesses 13D, and cushionings 5D according to a variation of the second embodiment. As illustrated in FIGS. 24 to 27, each of the cushionings 5D may include fit portions in the respective receiving surfaces for the to-be-accommodated object PA.

Figure 25:
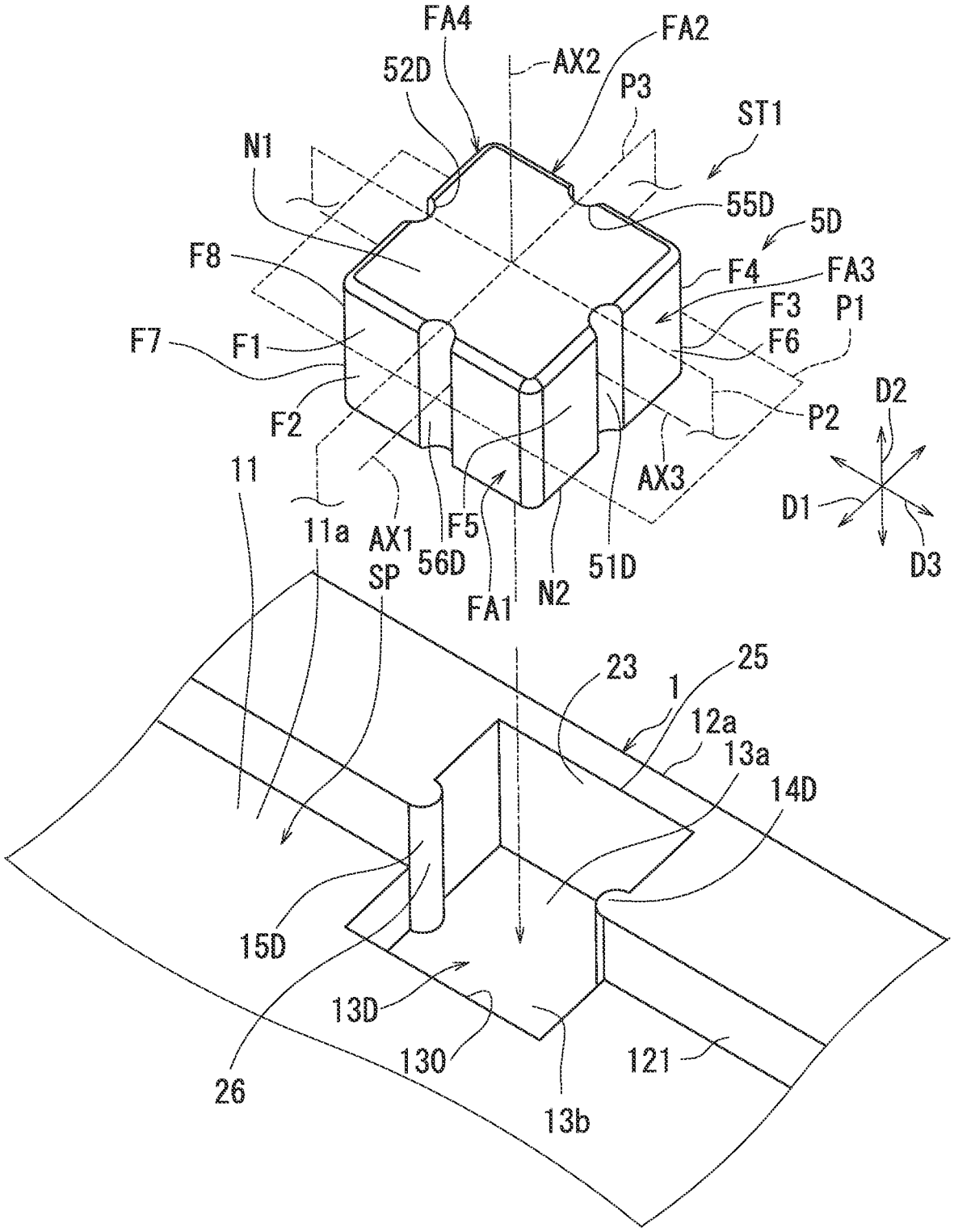
FIG. 25 is a perspective view of a recess in a container main body and a cushioning before being set in the recess according to the variation.
Figure 26:
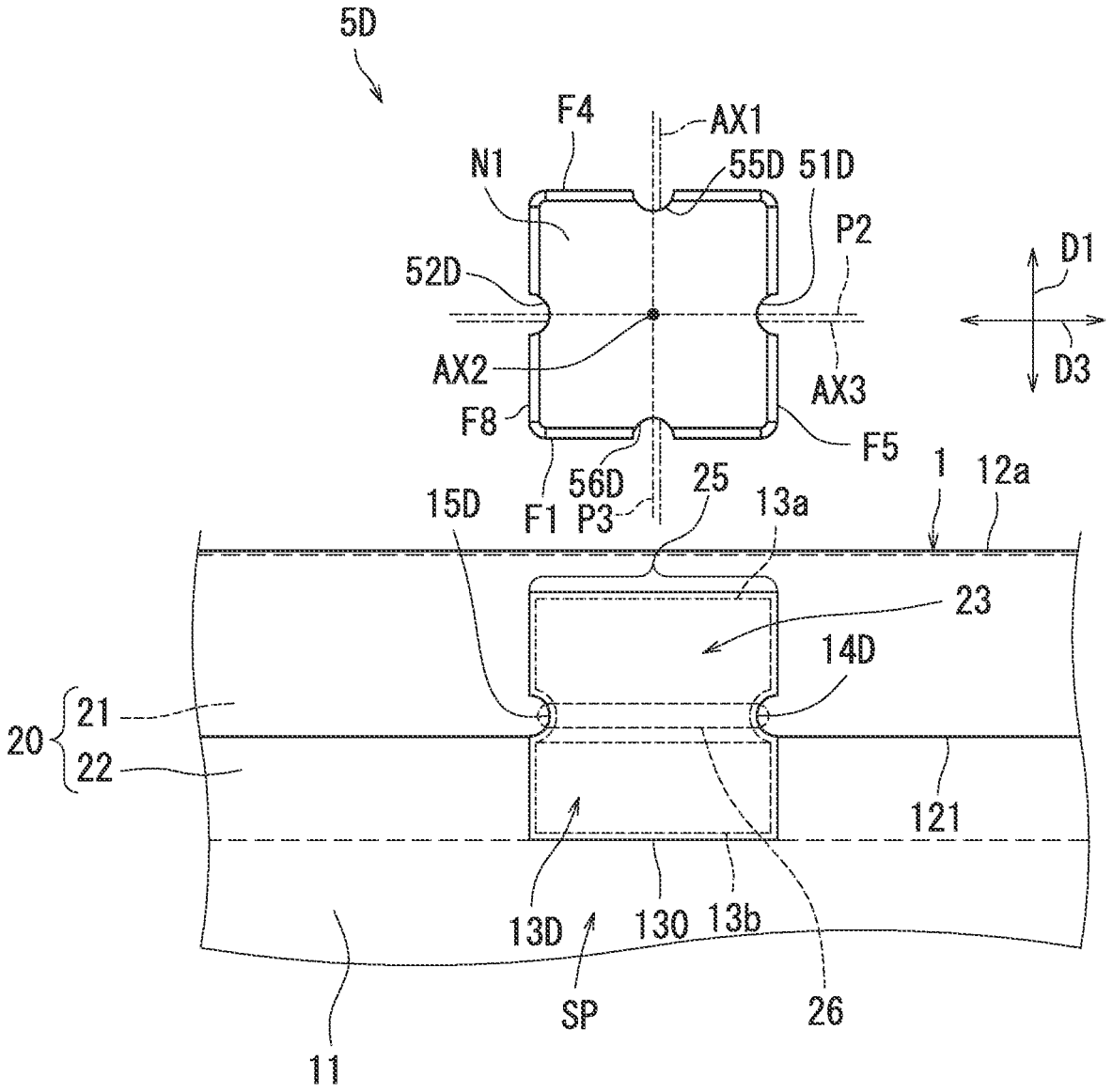
FIG. 26 is a perspective view of the recess in the container main body and the cushioning before being set in the recess according to the variation.
Figure 27:
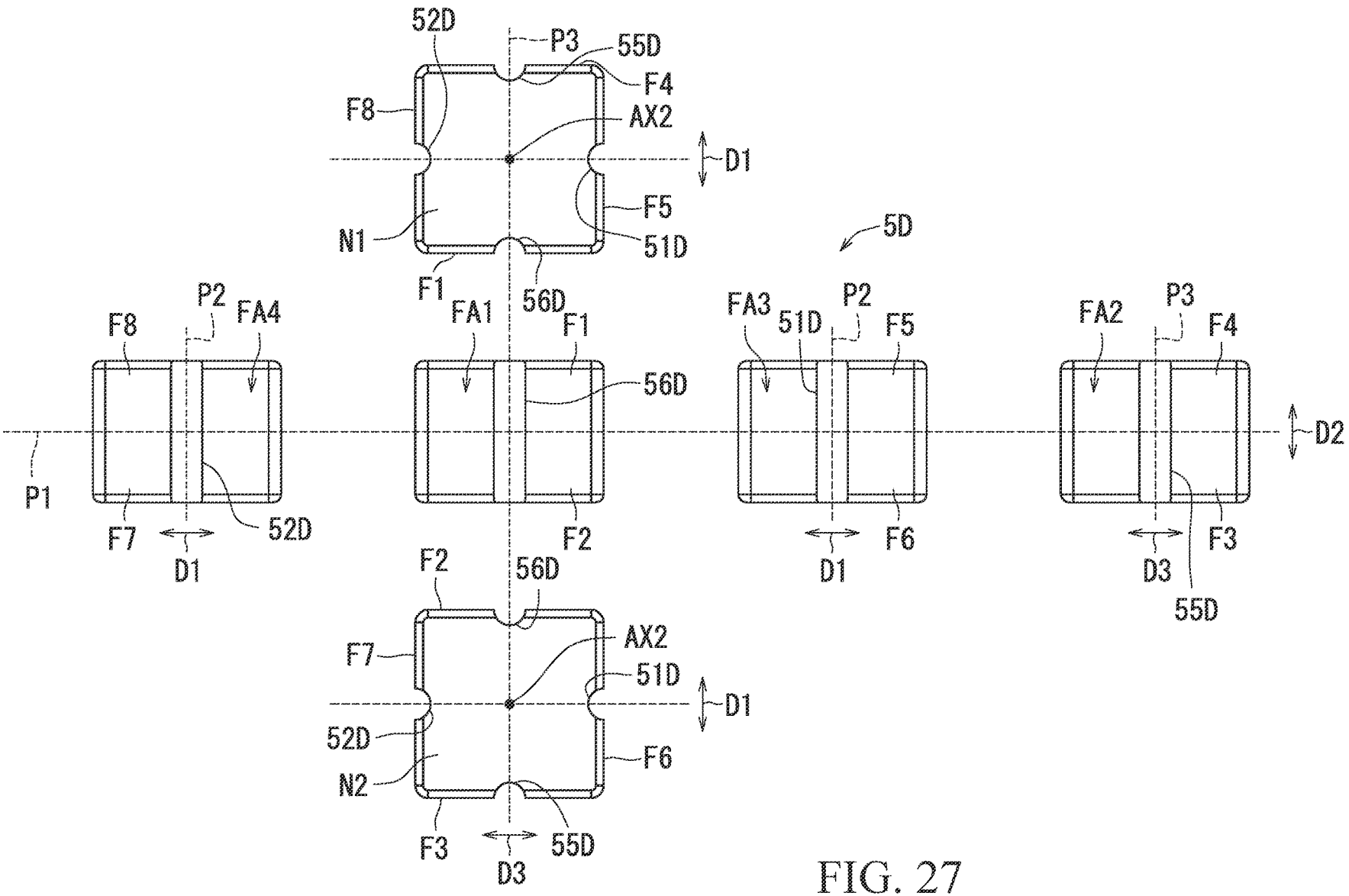
FIG. 27 is a 6-view diagram of the cushioning according to the variation.

As illustrated in FIGS. 25 and 26, the cushioning 5D includes a first fit portion 51D, a second fit portion 52D, a third fit portion 55D, and a fourth fit portion 56D. The first fit portion 51D is located at one end of the cushioning 5D in the third direction D3 in a state (the first posture state) in which the cushioning 5D in the first posture ST1 is set in a recess 13D. The second fit portion 52D is located at the other end of the cushioning 5D in the third direction D3 in the first posture state. The third fit portion 55D is located at one end of the cushioning 5D in the first direction D1 in the first posture state. The fourth fit portion 56D is located at the other end of the cushioning 5D in the first direction D1 in the first posture state.

The first fit portion 51D passes through the central parts of the fifth receiving surface F5 and the sixth receiving surface F6 in the first direction D1. The second fit portion 52D passes through the central parts of the seventh receiving surface F7 and the eighth receiving surface F8 in the first direction D1. The third fit portion 55D passes through the central parts of the third receiving surface F3 in the third direction D3 and the fourth receiving surface F4. The fourth fit portion 56D passes through the central parts of the first receiving surface F1 and the second receiving surface F2 in the third direction D3.

In one example, the first to fourth fit portions 51D to 56D are recesses with a substantially semicircular shape in planar view. Furthermore, the first to fourth fit portions 51D to 56D extend along the second direction D2 from the first non-receiving surface N1 to the second non-receiving surface N2. The first fit portion 51D and the second fit portion 52D are recessed toward each other along the third direction D3. The third fit portions 55D and the fourth fit portions 56D are recessed toward each other along the first direction D1.

Furthermore, the first to fourth fit portions 51D to 56D are symmetrical with respect to the second plane P2. The first to fourth fit portions 51D to 56D are symmetrical with respect to the third plane P3. Furthermore, the first to fourth fit portions 51D to 56D are 90-degree rotationally symmetrical about the second symmetric axis AX2. The first to fourth fit portions 51D to 56D are arranged at regular intervals in the peripheral direction about the second symmetric axis AX2.

The container main body 1 includes a first main body fit portion 14D and a second main body fit portion 15D. The first main body fit portion 14D and the second main body fit portion 15D each are provided so as to continuously extend from the side wall 12*a* to the recess 13D. The first main body fit portion 14D and the second main body fit portion 15D are arranged opposite to each other with a specific distance therebetween in the third direction D3. The first main body fit portion 14D and the second main body fit portion 15D are protrusions with a substantially semi-cylindrical shape protruding toward each other along the third direction D3.

The first main body fit portion 14D is fitted in any of the first fit portion 51D, the second fit portion 52D, the third fit portion 55D, and the fourth fit portion 56D according to the posture of the cushioning 5D set in the recess 13D. Similarly, the second main body fit portion 15D is fitted in any of the first fit portion 51D, the second fit portion 52D, the third fit portion 55D, and the fourth fit portion 56D according to the posture of the cushioning 5D set in the recess 13D. A fit portion fitted to the second main body fit portion 15D is a fit portion located on the opposite side to the fit portion fitted to the first main body fit portion 14D. In the above configuration, the cushioning 5D can be inhibited from inclining, displacing, and falling toward the accommodation space SP also in the variation of the second embodiment. Note that reuse of the cushioning 5D is the same as the reuse of the cushioning 5C described with reference to FIGS. 22 and 23.

Embodiments of the present disclosure have been described so far with reference to the drawings. However, the present disclosure is not limited to the above embodiments and may be implemented in various manners within a scope not departing from the gist thereof. Various elements of configuration disclosed in the above embodiments can be altered as appropriate. For example, some of the elements of configuration indicated in an embodiment may be added to the elements of configuration in another embodiment. Furthermore, some of all the elements of configuration indicated in an embodiment may be omitted from the embodiment.

The drawings schematically illustrate elements of configuration in order to facilitate understanding. Properties such as thickness, length, number, intervals of elements of configuration illustrated in the drawings may differ from actual properties in order to facilitate preparation of the drawings. Furthermore, each element of configuration indicated in the above embodiments is an example and not a particular limitation. Various alterations may be made so long as there is no substantial deviation from the effects of the present disclosure.

(1) In the first embodiment, the first variation, and the second variation, the number of available times of reuse (first time plus the number of times of reuse) of each of the cushionings 5, 5A, and 5B is "4" as one example due to the cushionings 5, 5A, and 5B each having four receiving surfaces (first to fourth receiving surfaces F1 to F4). Furthermore, in the second embodiment and the variation, the number of available times of reuse of each of the cushionings 5C and 5D is "8" as one example due to the cushionings 5C and 5D each having eight receiving surfaces (first to eighth receiving surfaces F1 to F8). However, the number of available times of reuse of each of the cushionings 5 and 5A to 5D is not limited particularly. For example, the number of available times of reuse of each of the cushionings 5 and 5A to 5D may be determined according to the material of the cushionings 5 and 5A to 5D.

For example, in a case in which each cushioning 5 (FIG. 5) is made of foamed polystyrene whose performance is liable to be impaired, it is preferable to change the receiving surface (first to fourth receiving surfaces F1 to F4) for receiving the to-be-accommodated objects PA by changing the posture of the cushioning 5 each time the one-time use is finished. In this case, the number of available times of reuse of the cushioning 5 is "4". Accordingly, the cost of the cushioning 5 can be reduced to approximately ¼ from that in a case in which a cushioning with one receiving surface is replaced each time. In particular, since foamed polystyrene is relatively inexpensive, sufficient cost benefits can be enjoyed even in a case in which the receiving surface for the to-be-accommodated objects PA is changed each time the one-time use is finished.

By contrast, for example, in a case in which each cushioning 5 (FIG. 5) is made of foamed polyethylene or foamed polypropylene whose performance is hardly impaired, one receiving surface can be used multiple times. When each receiving surface is used N times (N is an integer of at least 2), the number of available times of reuse of the cushioning 5 is "4×N". Accordingly, the cost of the cushioning 5 can be reduced to approximately ¼N from that in a case in which a cushioning with one receiving surface is replaced each time.

(2) For example, the cushioning 5 (FIG. 5) has only the first receiving surface F1 and the second receiving surface F2 each as an exchangeable receiving surface in the first embodiment. In this case, rotation of the cushioning 5 by 180 degrees about the first symmetric axis AX1 can exchange the receiving surfaces. In this case, the number of available times of reuse of the cushioning 5 is "2" or "2×N" depending on the material of the cushioning 5.

Furthermore, the cushioning 5 (FIG. 5) in the first embodiment may have only the first receiving surface F1 and the fourth receiving surface F4 each as an exchangeable receiving surface, for example. In this case, rotation of the cushioning 5 by 180 degrees about the second symmetric axis AX2 can exchange the receiving surfaces. In this case, the number of available times of reuse of the cushioning 5 is "2" or "2×N" depending on the material of the cushioning 5. Furthermore, in this case, the depth L1 (FIG. 4) of the recess 13 may be shallower than half the length L2 of the cushioning 5 in the second direction D2. Note that the cushioning 5 may have only the first receiving surface F1 and the third receiving surface F3 each as an exchangeable receiving surface, for example.

(3) For example, it is possible to use half of the first non-receiving surface N1, the other half of the first non-receiving surface N1, half of the second non-receiving surface N2, and the other half of the second non-receiving surface N2 of the cushioning 5C (FIG. 21) each as a receiving surface for the to-be-accommodated objects PA in the second embodiment. In this case, the cushioning 5C is cubic in shape, for example. Further in this case, fit portions similar to the fifth fit portions 53 or the sixth fit portions 54 are provided in each of the first surface FA1, the second surface FA2, the third surface FA3, and the fourth surface FA4. In this case, the number of available times of reuse of the cushioning 5 is "12" or "12×N" depending on the material of the cushioning 5.

(4) In FIGS. 8 and 9, the cushioning 5 is 180-degree rotationally symmetrical about the third symmetric axis AX3. In the above configuration, the posture of the cushioning 5 may be changed from the second posture ST2 to the fourth posture ST4 by rotating the cushioning 5 in the second posture ST2 by 180 degrees about the third symmetric axis AX3. In this case, the fourth posture ST4 is a state achieved by flipping the cushioning 5 in the second posture ST2 back and forth. The word "forth" in "back and forth" means being inward in the first direction D1 of the container main body 1 and the word "back" in "back and forth" means being outward in the first direction D1 of the container main body 1.

(5) In the first embodiment described with reference to FIG. 4, the depth L1 of the recess 13 is substantially equal to half of the length L2 of the cushioning 5 in the second direction D2. The same applies to the cushionings 5A to 5D in this point.

Figure 28:
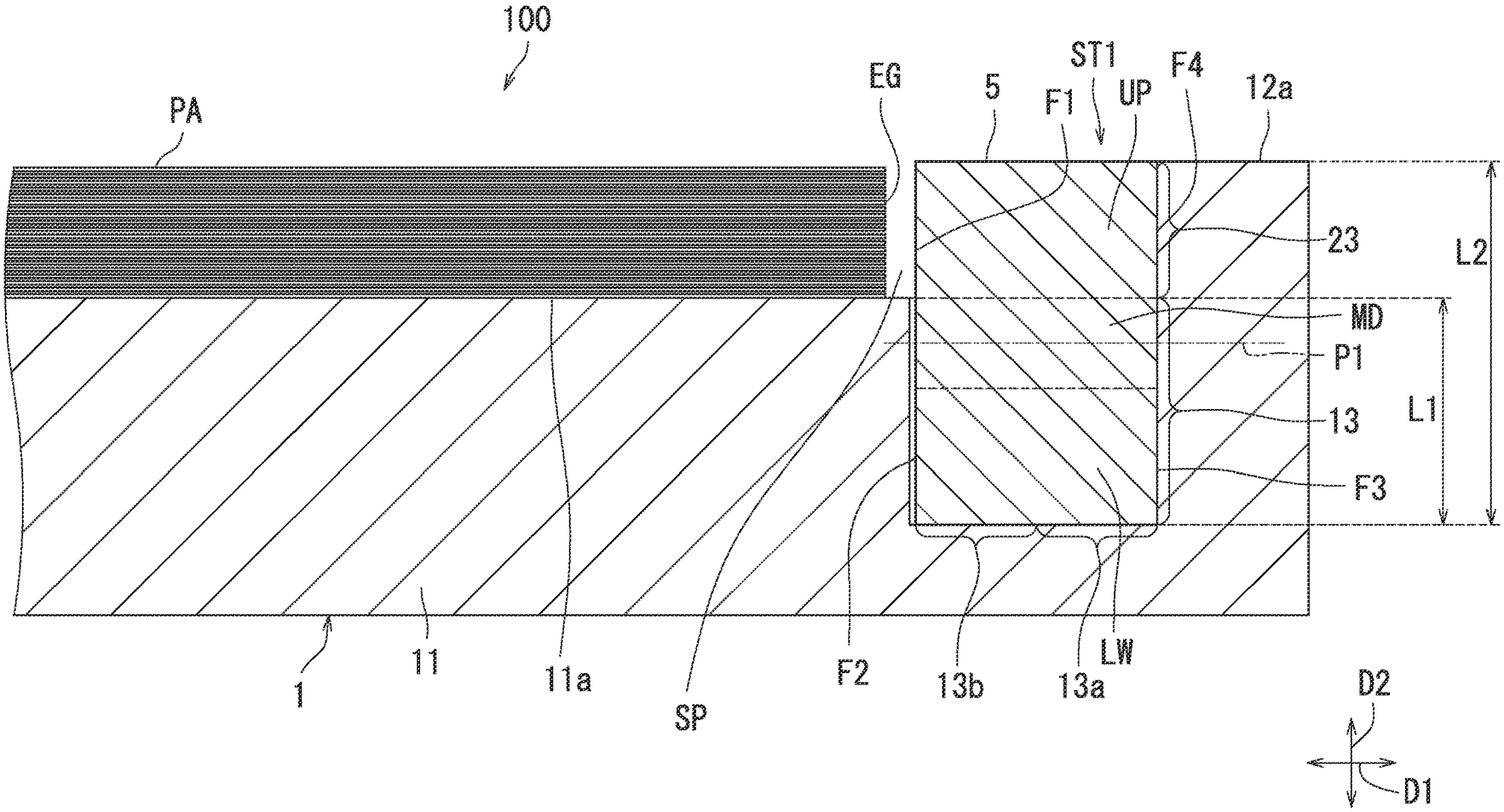
FIG. 28 is a diagram indicating the dimension of the recess and the dimension of the cushioning in another example of the embodiments of the present disclosure.

However, the present disclosure is not limited to the above. FIG. 28 is a diagram illustrating another example of the dimension of the recess 13 and the dimension of the cushioning 5. As illustrated in FIG. 28, the depth L1 of the recess 13 may be deeper than half of the length L1 of the cushioning 5 in the second direction D2. In this case, in changing the receiving surface for the to-be-accommodated objects PA from the first receiving surface F1 to the second receiving surface F2, the first receiving surface F1 that has been used as a receiving surface can be avoided from being exposed to the accommodation space SP. Therefore, performance of the cushioning 5 can be reliably maintained by posture change of the cushioning 5. The same applies to the cushionings 5A to 5D in this point.

Furthermore, in a configuration in which the depth L1 of the recess 13 is deeper than half the length L1 of the cushioning 5, the cushioning 5 further includes an intermediate part MD as illustrated in FIG. 28. The intermediate part MD is a part of the cushioning 5 that is located between a part UP with the first receiving surface F1 and the fourth receiving surface F4 and a part LW with the second receiving surface F2 and the third receiving surface F3. The first plane P1 passes through the central part of the cushioning 5 in the second direction D2 along the surface 11*a* of the base 11 in a state in which the cushioning 5 in the first posture ST1 is set in the recess 13. The first receiving surface F1 and the second receiving surface F2 are symmetrical with each other with respect to the first plane P1. The third receiving surface F3 and the fourth receiving surface F4 are symmetrical with each other with respect to the first plane P1. Note that the same applies to the cushionings 5A to 5D in the intermediate part MD and the first plane P1.

(6) In the first embodiment (including the variations), the cushionings 5, 5A, and 5B may each include the fifth fit portions 53 and the sixth fit portions 54 in the second embodiment in place of the first fit portions 51, 51A, and 51B and the second fit portions 52, 52A, and 52B. In this case, the recesses 13, 13A, and 13B have the base fit portions 16 in the second embodiment in place of the first main body fit portions 14, 14A, and 14B and the second main body fit portions 15, 15A, and 15B.

(7) No particular limitations are placed on the shapes of the fit portions and the main body fit portions described in each embodiment and each variation as long as the cushioning can be inhibited from falling toward the accommodation space SP, and any shape is possible.

(8) The receiving surfaces (first to eighth receiving surfaces F1 to F8) described in the embodiments and the variations are planer. However, the receiving surfaces are not limited to being planar as long as they are changeable and may include a curved surface or an uneven surface. Furthermore, the cushionings have a symmetrical configuration but may not have a symmetrical configuration as long as the receiving surfaces are changeable.

(9) With reference to FIGS. 5 and 6, a restriction section will be described. As illustrated in FIGS. 5 and 6, the container main body 1 includes a narrow width section 26 as a restriction section in each of the side wall 12*a* and the recess 13. The narrow width section 26 is provided so as to continuously extend from the side wall 12*a* to the recess 13 in the second direction D2. The narrow width section 26 restricts the cushioning 5 set in the recess 13 from moving toward the accommodation space SP. In the above configuration, the cushioning 5 can be further effectively inhibited from inclining, displacing, and falling toward the accommodation space SP.

Specifically, the cut 23 in the side wall 12*a* and the first portion 13*a* in the recess 13 each have a wide width section 25 and a narrow width section 26. The narrow width section 26 as the restriction section is narrower than the wide width section 25 in width in a direction (third direction D3) in which the side wall 12*a* extends and located closer to the accommodation space SP than the wide width section 25. The cushioning 5 has a shape that matches the cut 23 and the recess 13. In the above configuration, the cushioning 5 can be further effectively inhibited from inclining, displacing, and falling toward the accommodation space SP.

Note that each of the container main bodies 1 illustrated in FIGS. 11, 12, 15, 16, 25, and 26 includes a wide width section 25 and a narrow width section 26 serving as a restriction section likewise. Furthermore, each of the container main bodies 1 illustrated in FIGS. 5, 6, 11, 12, 15, 16, 25, and 26 may include a narrow width section 26 as a restriction section in either the side wall 12*a* or the recess.

With reference to FIGS. 19 and 20, a restriction section will be described. The container main body 1 includes the base fit portions 16 each serving as a restriction section in the recess 13C. The base fit portions 16 restrict the cushioning 5C set in the recess 13C from moving toward the accommodation space SP. In the above configuration, the cushioning 5C can be inhibited from inclining, displacing, and falling toward the accommodation space SP.

Specifically, the base fit portions 16 are protrusions (also referred to below as "protrusions 16"). The protrusions 16 as restriction sections are provided at the bottom of the recess 13C. The cushioning 5C includes the fifth fit portions 53 and the sixth fit portions 54 being holes to which the protrusions 16 are fitted when the cushioning 5C is set in the recess 13C.

What is claimed is:

1. A container comprising:

a container main body configured with an accommodation space that is to accommodate a to-be-accommodated object with a flat plate shape; and a cushioning to be set in the container main body, wherein the container main body includes:

a base;

a side wall standing from the base; and a recess that is formed in a peripheral part of the base and that is recessed from a surface of the base, the cushioning is to be set in the recess in multiple different postures, the cushioning has a first surface including a first receiving surface and a second receiving surface, in a state in which the cushioning in a first posture is set in the recess, the first receiving surface faces the accommodation space in a first direction substantially perpendicular to an inner surface of the side wall and the second receiving surface is buried in the recess, and in a state in which the cushioning in a second posture is set in the recess, the second receiving surface faces the accommodation space in the first direction and the first receiving surface is buried in the recess, wherein the recess has a depth, from the surface of the base, that is half of a length of the cushioning in a second direction or that is deeper than the half of the length of the cushioning in the second direction, and the second direction is a direction substantially perpendicular to the surface of the base.

2. The container according to claim 1, wherein the cushioning is 180-degree rotationally symmetrical about a first symmetric axis extending along the first direction, the first direction is further substantially perpendicular to the first surface, and in the state in which the cushioning in the first posture is set in the recess, the first receiving surface and the second receiving surface are symmetrical with each other with respect to a specific plane that passes through a central part of the cushioning in the second direction and that is substantially in parallel to the surface of the base.

3. The container according to claim 1, wherein the cushioning further includes:

a first fit portion located at one end of the cushioning in a third direction in the state in which the cushioning in the first posture is set in the recess; and a second fit portion located at another end of the cushioning in the third direction in the state in which the cushioning in the first posture is set in the recess, the third direction is a direction substantially parallel to the first surface and the surface of the base, and the container main body further includes:

a first main body fit portion that is provided so as to continuously extend from the side wall to the recess and that engages with one of the first fit portion and the second fit portion according to a posture of the cushioning set in the recess; and a second main body fit portion that is provided so as to continuously extend from the side wall to the recess and that engages with another one of the first fit portion and the second fit portion according to the posture of the cushioning set in the recess.

4. The container according to claim 1, wherein the cushioning further includes:

a fifth fit portion located at one end of the cushioning in the second direction in the state in which the cushioning in the first posture is set in the recess; and a sixth fit portion located at another end of the cushioning in the second direction in the state in which the cushioning in the first posture is set in the recess, the recess includes a base fit portion provided at a bottom of the recess, and the base fit portion is fitted to either the fifth fit portion or the sixth fit portion according to a posture of the cushioning set in the recess.

5. The container according to claim 1, wherein the peripheral part of the base has:

a first area located outside a position that aligns with an inner surface of the side wall in a planar view; and a second area located inside the position that aligns with the inner surface of the side wall in the planar view, the recess is formed so as to continuously extend from the first area to the second area, the side wall is configured with a cut that matches a first portion of the recess that belongs to the first area in the planar view, and a part of the cushioning set in the recess is located in the cut in the side wall.

6. A container comprising:

a container main body configured with an accommodation space that is to accommodate a to-be-accommodated object with a flat plate shape; and a cushioning to be set in the container main body, wherein the container main body includes:

a base;

a side wall standing from the base; and a recess that is formed in a peripheral part of the base and that is recessed from a surface of the base, the cushioning is to be set in the recess in multiple different postures, the cushioning has a first surface including a first receiving surface and a second receiving surface, in a state in which the cushioning in a first posture is set in the recess, the first receiving surface faces the accommodation space and the second receiving surface is buried in the recess, and in a state in which the cushioning in a second posture is set in the recess, the second receiving surface faces the accommodation space and the first receiving surface is buried in the recess, wherein the cushioning further has a second surface located on an opposite side of the first surface, the second surface includes a third receiving surface and a fourth receiving surface, in a state in which the cushioning in a third posture is set in the recess, the third receiving surface faces the accommodation space, the fourth receiving surface is buried in the recess, and the first receiving surface and the second receiving surface confront an opposite side of the accommodation space, and in a state in which the cushioning in a fourth posture is set in the recess, the fourth receiving surface faces the accommodation space, the third receiving surface is buried in the recess, and the first receiving surface and the second receiving surface confront the opposite side of the accommodation space.

7. The container according to claim 6, wherein the cushioning is 180-degree rotationally symmetrical about a first symmetric axis extending along a first direction, the cushioning is 180-degree rotationally symmetrical about a second symmetric axis extending along a second direction perpendicular to the first direction, the first direction is a direction substantially perpendicular to the first surface, in the state in which the cushioning in the first posture is set in the recess, the second direction corresponds to a direction substantially perpendicular to the surface of the base, the first surface and the second surface are located on opposite sides of each other with the second symmetric axis therebetween, in the state in which the cushioning in the first posture is set in the recess, the first receiving surface and the second receiving surface are symmetrical with each other with respect to a specific plane that passes through a central part of the cushioning in the second direction and that is substantially in parallel to the surface of the base, and in the state in which the cushioning in the first posture is set in the recess, the third receiving surface and the fourth receiving surface are symmetrical with each other with respect to the specific plane.

8. The container according to claim 6, wherein the cushioning further has:

a third surface that includes a fifth receiving surface and a sixth receiving surface and that connects one end of the first surface to one end of the second surface; and a fourth surface that includes a seventh receiving surface and an eighth receiving surface and that connects another end of the first surface to another end of the second surface, in a state in which the cushioning in a fifth posture is set in the recess, the fifth receiving surface faces the accommodation space, the sixth receiving surface is buried in the recess, and the seventh receiving surface and the eighth receiving surface confront the opposite side of the accommodation space, in a state in which the cushioning in a sixth posture is set in the recess, the sixth receiving surface faces the accommodation space, the fifth receiving surface is buried in the recess, and the seventh receiving surface and the eighth receiving surface confront the opposite side of the accommodation space, in a state in which the cushioning in a seventh posture is set in the recess, the seventh receiving surface faces the accommodation space, the eighth receiving surface is buried in the recess, and the fifth receiving surface and the sixth receiving surface confront the opposite side of the accommodation space, and in a state in which the cushioning in an eighth posture is set in the recess, the eighth receiving surface faces the accommodation space, the seventh receiving surface is buried in the recess, and the fifth receiving surface and the sixth receiving surface confront the opposite side of the accommodation space.

9. The container according to claim 8, wherein the cushioning is 180-degree rotationally symmetrical about a first symmetric axis extending along a first direction, the cushioning is 90-degree rotationally symmetrical about a second symmetric axis extending along a second direction perpendicular to the first direction, the first direction is a direction substantially perpendicular to the first surface, in the state in which the cushioning in the first posture is set in the recess, the second direction corresponds to a direction substantially perpendicular to the surface of the base, the first surface and the second surface are located on opposite sides of each other with the second symmetric axis therebetween, the third surface and the fourth surface are located on opposite sides of each other with the second symmetric axis therebetween, in the state in which the cushioning in the first posture is set in the recess, the first receiving surface and the second receiving surface are symmetrical with each other with respect to a specific plane that passes through a central part of the cushioning in the second direction and that is substantially in parallel to the surface of the base, in the state in which the cushioning in the first posture is set in the recess, the third receiving surface and the fourth receiving surface are symmetrical with each other with respect to the specific plane, in the state in which the cushioning in the first posture is set in the recess, the fifth receiving surface and the sixth receiving surface are symmetrical with each other with respect to the specific plane, and in the state in which the cushioning in the first posture is set in the recess, the seventh receiving surface and the eighth receiving surface are symmetrical with each other with respect to the specific plane.

10. The container according to claim 8, wherein the cushioning further includes:

a first fit portion located at one end of the cushioning in a third direction in the state in which the cushioning in the first posture is set in the recess;

a second fit portion located at another end of the cushioning in the third direction in the state in which the cushioning in the first posture is set in the recess;

a third fit portion located at one end of the cushioning in a first direction in the state in which the cushioning in the first posture is set in the recess; and a fourth fit portion located at another end of the cushioning in the first direction in the state in which the cushioning in the first posture is set in the recess, the first direction is a direction substantially perpendicular to the first surface, the third direction is a direction substantially parallel to the first surface and the surface of the base, the container main body further includes a first main body fit portion and a second main body fit portion that are provided so as to continuously extend from the side wall to the recess and that are located opposite each other with a specific distance therebetween, the first main body fit portion is fitted to one fit portion among the first fit portion, the second fit portion, the third fit portion, and the fourth fit portion according to a posture of the cushioning set in the recess, and according to the posture of the cushioning set in the recess, the second main body fit portion is fitted to another fit portion among the first fit portion, the second fit portion, the third fit portion, and the fourth fit portion, the other fit portion being located on an opposite side of the one fit portion that is fitted to the first main body fit portion.

11. A container comprising:

a container main body configured with an accommodation space that is to accommodate a to-be-accommodated object with a flat plate shape; and a cushioning to be set in the container main body, wherein the container main body includes:

a base;

a side wall standing from the base; and a recess that is formed in a peripheral part of the base and that is recessed from a surface of the base, the cushioning is to be set in the recess in multiple different postures, the cushioning has a first surface including a first receiving surface and a second receiving surface, in a state in which the cushioning in a first posture is set in the recess, the first receiving surface faces the accommodation space and the second receiving surface is buried in the recess, and in a state in which the cushioning in a second posture is set in the recess, the second receiving surface faces the accommodation space and the first receiving surface is buried in the recess, wherein the peripheral part of the base has:

a first area located outside a position that aligns with an inner surface of the side wall in a planar view; and a second area located inside the position that aligns with the inner surface of the side wall in the planar view, the recess is formed so as to continuously extend from the first area to the second area, the side wall is configured with a cut that matches a first portion of the recess that belongs to the first area in the planar view, and a part of the cushioning set in the recess is located in the cut in the side wall, wherein the container main body further includes, in either one or both of the side wall and the recess, a restriction section that restricts the cushioning set in the recess from moving toward the accommodation space.

12. The container according to claim 11, wherein the cut in the side wall and the first portion of the recess each includes:

a wide width section; and a narrow width section that is narrower than the wide width section, in width, in a direction in which the side wall extends and that is located closer to the accommodation space than the wide width section, the narrow width section serving as the restriction section, and the cushioning further has a shape that matches the cut and the recess.

13. The container according to claim 11, wherein a protrusion serving as the restriction section is formed on a bottom of the recess, and the cushioning is configured with a hole to which the protrusion is to be fitted when the cushioning is set in the recess.

* * * * *